US010132054B2

(12) United States Patent
Ackermann et al.

(10) Patent No.: US 10,132,054 B2
(45) Date of Patent: Nov. 20, 2018

(54) QUICK HITCH

(71) Applicant: J.C. BAMFORD EXCAVATORS LIMITED, Uttoxeter (GB)

(72) Inventors: Stephen Ackermann, Uttoxeter (GB); Paul Bigoney, Uttoxeter (GB); Christopher Nierenhausen, Uttoxeter (GB); Doug McIlwain, Uttoxeter (GB); Ken Walton, Uttoxeter (GB)

(73) Assignee: J.C. BAMFORD EXCAVATORS LIMITED, Uttoxeter (GB)

( * ) Notice: Subject to any disclaimer, the term of this patent is extended or adjusted under 35 U.S.C. 154(b) by 0 days.

(21) Appl. No.: 15/291,852

(22) Filed: Oct. 12, 2016

(65) Prior Publication Data

US 2017/0107685 A1 Apr. 20, 2017

(30) Foreign Application Priority Data

Oct. 15, 2015 (GB) ..... 1518253.8

(51) Int. Cl.
*E02F 3/36* (2006.01)
*E02F 9/26* (2006.01)

(52) U.S. Cl.
CPC ..... *E02F 3/3631* (2013.01); *E02F 3/364* (2013.01); *E02F 3/3618* (2013.01); *E02F 3/3627* (2013.01); *E02F 3/3659* (2013.01); *E02F 3/3668* (2013.01); *E02F 3/3672* (2013.01); *E02F 9/26* (2013.01)

(58) Field of Classification Search
CPC ..... E02F 3/3631; E02F 3/3659; E02F 3/3668
See application file for complete search history.

(56) References Cited

U.S. PATENT DOCUMENTS 3,531,140 A 9/1970 Di Vita et al.
4,119,225 A 10/1978 Macht et al.
(Continued)

FOREIGN PATENT DOCUMENTS

CA 814808 6/1969
DE 93 14 409 U1 3/1994
(Continued)

OTHER PUBLICATIONS

Partial European Search Report for EP 16 19 1790, dated Mar. 17, 2017.

(Continued)

*Primary Examiner* — Tara Mayo-Pinnock
(74) *Attorney, Agent, or Firm* — Marshall, Gerstein & Borun LLP

(57) ABSTRACT

A quick hitch for mounting an implement on a machine includes at least one lug for connecting the machine and a securing assembly for securing the quick hitch to an implement. The securing assembly includes an over-center mechanism and a locking member. The over-center mechanism includes a first member pivotal at an axis D relative to a chassis, a first end of a first link that pivots at an axis E relative to a first arm of the first member, and a second end of the link that pivots at an axis F. When the securing assembly is in a first position with the hitch secured to an implement, axis E lies on a first side of a line between axes D and F. When in a second position with the hitch unattached, axis E lies on a second side of a line between axes D and F.

13 Claims, 17 Drawing Sheets

(56) References Cited

U.S. PATENT DOCUMENTS

| | | | | |
|---|---|---|---|---|
| 5,419,673 | A | 5/1995 | Merhar | |
| 5,456,030 | A | 10/1995 | Barone et al. | |
| 5,685,689 | A | 11/1997 | Schneider et al. | |
| 5,692,855 | A | 12/1997 | Burton | |
| 5,769,596 | A | 6/1998 | Burton | |
| 5,836,734 | A | 11/1998 | Doering | |
| 6,170,178 | B1 * | 1/2001 | Christy | E01H 5/06 172/272 |
| 6,301,811 | B1 | 10/2001 | Gilmore, Jr. | |
| 6,332,748 | B1 | 12/2001 | Doering et al. | |
| 7,513,732 | B1 | 4/2009 | Callens | |
| 7,562,718 | B1 | 7/2009 | Moorman et al. | |
| 2003/0066215 | A1 | 4/2003 | Grant | |
| 2014/0096419 | A1 | 4/2014 | Pinther et al. | |

FOREIGN PATENT DOCUMENTS

| | | | |
|---|---|---|---|
| GB | 2345686 | A | 7/2000 |
| GB | 2412361 | | 9/2005 |
| GB | 2 451 304 | A | 1/2009 |
| JP | H0417443 | | 2/1992 |

OTHER PUBLICATIONS

Search Report for GB1518253.8, dated Apr. 20, 2017.
Search Report for GB 1518253.8 dated Dec. 23, 2015.

* cited by examiner

QUICK HITCH

FIELD OF THE INVENTION

The present invention relates to a quick hitch, in particular a quick hitch for mounting an implement on a machine, for example a working machine or a construction machine.

BACKGROUND OF THE INVENTION

Quick hitches, also known as quick couplers, are installed on working machines, such as excavators, backhoe loaders and telescopic handlers, to facilitate the connection of attachments or implements, for example working tools or buckets, on the machines.

Known quick hitches suffer the disadvantage that their lifecycle is limited by wear and damage that occurs during use.

A further disadvantage of known quick hitches is that whilst they facilitate more rapid installation of attachments or implements on machines, the connection between the attachment or implement and the quick hitch is less robust than for traditional mountings.

A yet further disadvantage of known quick hitches is that it is not immediately apparent to an operator of a machine if an implement is locked on the quick hitch.

It is therefore an object of the present invention to provide an improved quick hitch for mounting an implement on a machine.

SUMMARY OF THE INVENTION

According to a first aspect of the present invention there is provided a quick hitch for mounting an implement on a machine, the quick hitch including at least one mounting means for connection to a machine and a securing means for securing the quick hitch to an implement, the quick hitch further including at least one removable plate for engagement with a surface of an implement.

The at least one removable plate advantageously prolongs the lifecycle of the quick hitch as they provide a surface that engages the implement and can be replaced if/when the surface becomes worn in use.

The at least one removable plate may be mounted on an upper surface of the quick hitch. The at least one removable plate may be mounted on an upper surface of the quick hitch by at least one fastening means, for example a bolt.

The at least one removable plate may have a length and the quick hitch have a length and to the ratio of the length of the removable plate to the length of the quick hitch may be less than one to three. The ratio of the length of the removable plate to the length of the quick hitch may be greater than one to six.

The at least one removable plate may be configured to fit under a lip on an implement.

The at least one removable plate may have a surface that engages a lip on an implement in use. The surface of the at least one removable plate may be sloped.

The at least one removable plate may include a metallic material. The at least one removable plate may include steel.

The quick hitch may include at least two removable plates for engagement with a surface of an implement.

The quick hitch may include an enclosure. The enclosure may be any enclosure as described in connection with the second aspect of the invention.

The quick hitch may include an over-center mechanism. The over-center mechanism may be any over-center mechanism as described in connection with the third aspect of the invention.

The quick hitch may include a resilient link. The resilient link may be any resilient link as described in connection with the fourth aspect of the invention.

According to a second aspect of the present invention there is provided a quick hitch for mounting an implement on a machine, the quick hitch including an enclosure, the enclosure including at least one mounting means for connection to a machine, the enclosure accommodating a securing means for securing the quick hitch to an implement, the securing means having a first position in which the quick hitch is secured to an implement and a second position in which the quick hitch is not secured to an implement, the enclosure further including a first aperture through which a portion of the securing means extends when the securing means is in the first position.

The enclosure advantageously prolongs the lifecycle of the quick hitch as it prevents dirt and debris collecting on the quick hitch mechanism in use.

The securing means may include a signal means, the signal means having a first position for signaling that the quick hitch is secured to an implement when the securing means is in the first position and a second position for signaling that the quick hitch is not secured to an implement when the securing means is in the second position and the enclosure further includes an opening through which a portion of the signal means may extend.

The portion of the signal means may extend through the opening when the signal means is in the first position and/or the second position.

The securing means may include an actuator and/or the signal means may be connected to the actuator.

The actuator may be a manual actuator. The manual actuator may comprise a single handle.

The actuator may be an electric actuator.

The opening may include a cover for preventing the ingress of dirt or debris into the enclosure and through which the portion of the signal means may extend. The cover may include a plurality of bristles. The cover may include at least one brush.

The at least one mounting means may be provided on an exterior surface of the enclosure. The at least one mounting means may be a lug.

The enclosure may include a second aperture through which a second portion of the securing means may extend when the securing means is in the first position.

The enclosure may include at least one removable plate for engagement with a surface of an implement. The at least one removable plate may be any removable plate as described in connection with the first aspect of the invention.

The quick hitch may include an over-center mechanism. The over-center mechanism may be any over-center mechanism as described in connection with the third aspect of the invention.

The quick hitch may include a resilient link. The resilient link may be any resilient link as described in connection with the fourth aspect of the invention.

According to a third aspect of the present invention there is a quick hitch for mounting an implement on a machine, the quick hitch including at least one mounting means for connection to a machine and a securing means for securing the quick hitch to an implement, the securing means including an over-center mechanism and a locking member, the over-center mechanism including a first link and a first pivotable member, wherein the first pivotable member is pivotal at a first axis D relative to a chassis of the quick hitch, a first end of the first link is pivotal at a second axis E relative to a first arm of the first pivotable member, and a second end of the first link is pivotal at a third axis F relative to the locking member, such that with the securing means in a first position, in which the quick hitch is secured to an implement, axis E lies on a first side of a straight line drawn between axes D and F and with the securing means in a second position, in which the quick hitch is not secured to an implement, axis E lies on a second side of a straight line drawn between axes D and F.

The over-center mechanism advantageously increases the robustness of the connection between the implement or attachment and the quick hitch as it ensures that the locking member is held in position when the securing means is in the first position.

The locking member may include a projection for engaging an implement when the securing means is in a first position.

The quick hitch may include a first pin and the first pivotable member may include a second arm, such that with the securing means in the first position, the second arm is in abutment with the first pin and with the securing means in the second position, the second arm is spaced from the first pin.

The quick hitch may further include a second pivotable member and the securing means may include a second link, wherein a first end of the second pivotable member is pivotal at a fourth axis A relative to the chassis of the quick hitch, a first end of the second link is pivotal at a fifth axis B relative to the second pivotable member, and a second end of the second link is pivotal at a sixth axis C relative to the first pivotable member, such that with the securing means in the first position, axis B lies on a first side of a straight line drawn between axes A and C and with the securing means in the second position, axis B lies on a second side of a straight line drawn between axes A and C.

A second end of the second pivotable member may be an actuator for moving the securing means from the first position to the second position. The actuator may be a manual actuator. The actuator may comprise a single handle.

The second end of the second pivotable member may include a signal means, the signal means having a first position for signaling that the quick hitch is secured to an implement when the securing means is in the first position and a second position for signaling that the quick hitch is not secured to an implement when the securing means is in the second position.

The first link and/or the second link may be a resilient link.

The securing means may include an actuator that is operably connected to the first pivotable member such that actuation of the actuator causes the securing means to move from the first position to the second position.

The actuator may be a screw actuator. The actuator may be an electric actuator.

The quick hitch may include a second pin and the first pivotable member may include a leg, such that with the securing means in the first position, the leg is in abutment with the second pin and with the securing means in the second position, the leg is spaced from the second pin.

The leg may include a signal means, the signal means having a first position for signaling that the quick hitch is secured to an implement when the securing means is in the first position and a second position for signaling that the quick hitch is not secured to an implement when the securing means is in the second position.

The first link may be a resilient link.

The over-center mechanism of the securing means may be a first over-center mechanism, the locking member may be a first locking member, the first link may be a first first link, the first pivotable member may be a first first pivotable member, the first axis D may be the first first axis, the second axis E may be the first second axis, the first arm of the first first pivotable member may be the first first arm and the third axis F may be the first third axis, the securing means may further include a second over-center mechanism and a second locking member, the second over-center mechanism may include a second first link and a second first pivotable member, wherein the second first pivotable member may be pivotal at a second first axis D' relative to a chassis of the quick hitch, a first end of the second first link may be pivotal at a second second axis E' relative to a second first arm of the second first pivotable member, and a second end of the second first link may be pivotal at a second third axis F' relative to the second locking member, such that with the securing means in a first position, in which the quick hitch is secured to an implement, axis E' lies on a first side of a straight line drawn between axes D' and F' and with the securing means in a second position, in which the quick hitch is not secured to an implement, axis E' lies on a second side of a straight line drawn between axes D' and F'.

The quick hitch may further include at least one removable plate for engagement with a surface of an implement. The at least one removable plate may be any removable plate as described in connection with the first aspect of the invention.

The quick hitch may further include an enclosure. The enclosure may be any enclosure as described in connection with the second aspect of the invention.

The resilient link may be any resilient link as described in connection with the fourth aspect of the invention.

According to a fourth aspect of the present invention there is provided a quick hitch for mounting an implement on a machine, the quick hitch including at least one mounting means for connection to a machine and a securing means for securing the quick hitch to an implement, the securing means including a locking member and a second pivotable member, wherein the locking member and the second pivotable member are connected by a resilient link; the securing means having a first position in which the quick hitch is secured to an implement and a second position in which the quick hitch is not secured to an implement, wherein when the securing means is in the first position, the resilient link allows movement of the securing means to a third position which is between the first position and the second position.

The resilient link advantageously increases the robustness of the connection between the implement or attachment and the quick hitch as it ensures positive engagement of the locking member and maintains the quick hitch in compression to prevent the locking members becoming loose and rattling which may cause the implement to become dislodged from the quick hitch.

The locking member may have a first position when the securing means is in the first position and a second position when the securing means is in the third position and the first and second positions of the locking member may be separated by an axial distance.

The axial distance may be less than 20 millimeters, preferably less than 16 millimeters. The axial distance may be greater than 10 millimeters, preferably greater than 12 millimeters.

The securing means may further include a first link, a first pivotable member and a second link, wherein the first pivotable member is pivotal at a first axis D relative to a chassis of the quick hitch, a first end of the first link is pivotal at a second axis E relative to a first arm of the first pivotable member, a second end of the first link is pivotal at a third axis F relative to the locking member, a first end of the second pivotable member is pivotal at a fourth axis A relative to the chassis of the quick hitch, a first end of the second link is pivotal at a fifth axis B relative to the second pivotable member, and a second end of the second link is pivotal at a sixth axis C relative to the first pivotable member.

One or more of the first link, the first pivotable member, the second link and/or the second pivotable member may be the resilient link. The first link may be the resilient link.

The quick hitch may include a first pin and the first pivotable member may include a second arm, such that with the securing means in the first position, the second arm is in abutment with the first pin and with the securing means in the second position, the second arm is spaced from the first pin.

The second pivotable member may include a signal means, the signal means may have a first position for signaling that the quick hitch is secured to an implement when the securing means is in the first position and a second position for signaling that the quick hitch is not secured to an implement when the securing means is in the second position.

The locking member may be pivotally connected to the resilient link.

The second pivotable member may be a manual actuator. The manual actuator may comprise a single handle.

The securing means may include an electric actuator. The electric actuator may be operably connected to the second pivotable member such that actuation of the actuator causes the securing means to move from the first position to the second position.

The quick hitch may include a second pin and the second pivotable member may include a leg, such that with the securing means in the first position, the leg is in abutment with the second pin and with the securing means in the second position, the leg is spaced from the second pin.

The leg may include a signal means, the signal means having a first position for signaling that the quick hitch is secured to an implement when the securing means is in the first position and a second position for signaling that the quick hitch is not secured to an implement when the securing means is in the second position.

The locking member may be the first locking member, the second pivotable member may be the first second pivotable member, and the resilient link may be the first resilient link, the securing means may further include a second locking member and a second second pivotable member, wherein the second locking member and the second second pivotable member are connected by a second resilient link, wherein when the securing means is in the first position, the second resilient link allows movement of the securing means to a third position which is between the first position and the second position.

The quick hitch may include at least one removable plate for engagement with a surface of an implement. The at least one removable plate may be any removable plate as described in connection with the first aspect of the invention.

The quick hitch may include an enclosure. The enclosure may be any enclosure as described in connection with the second aspect of the invention.

The quick hitch may include an over-center mechanism. The over-center mechanism may be any over-center mechanism as described in connection with the third aspect of the invention.

BRIEF DESCRIPTION OF THE DRAWINGS

Embodiments of the present invention will now be described with reference to the accompanying Figures in which.

DETAILED DESCRIPTION

Figure 1:
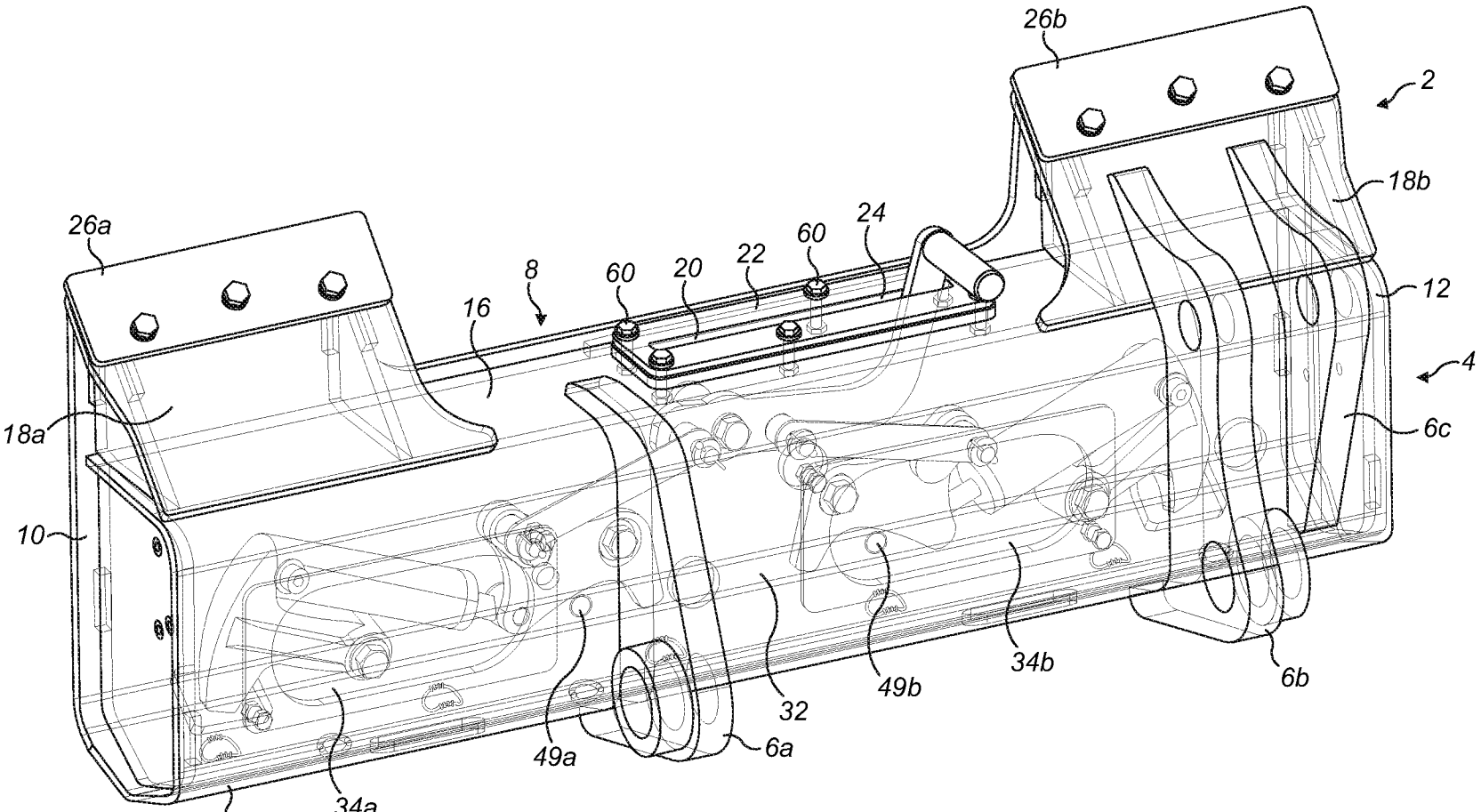
FIG. 1 is an isometric rear view of a quick hitch according to a first embodiment of the present invention in an unlocked position.

Referring now to FIGS. 1 to 8, 17, 18, 21 and 22, there is shown a quick hitch 2 according to a first embodiment of the invention.

FIGS. 1 to 4 and 21 show the quick hitch 2 in an unlocked position and FIGS. 5 to 8, 17, 18 and 22 show the quick hitch 2 in a locked position.

The quick hitch 2 has a body 4, mounting means 6*a*, 6*b*, 6*c* for mounting the quick hitch 2 on a machine and securing means 8 for securing an implement to the quick hitch 2.

The quick hitch 2 also includes a first pin 49*a*, second pin 49*b* and pivots 138, 140, 142, 144, 146. Each of the first pin 49*a*, second pin 49*b* and pivot 138 which has an axis G, pivot 140 which has an axis D, pivot 142 which has an axis C, pivot 144 which has an axis D', pivot 146 which has an axis G' are mounted on a chassis of the quick hitch 2.

The body 4 has side walls 10, 12, a base 14, an upper surface 16, a front wall 30 and a rear wall 32.

The base 14 has a pair of apertures 28*a*, 28*b*.

The upper surface 16 has an opening 20 and a plate 22. The plate 22 has an opening 24 that corresponds to the opening 20 in the upper surface 16. The plate 22 has brushes (not shown) within the opening 24.

The front wall 30 is generally U-shaped.

The rear wall 32 includes a pair of access doors 34*a*, 34*b*. The mounting means 6*a*, 6*b*, 6*c* are mounted on the rear wall 32 and have lugs 7*a*, 7*b*, 7*c*, with apertures 9*a*, 9*b*, 9*c* for receiving supporting pins (not shown). The rear wall 32 also includes a pair of upwardly extending arms 18*a*, 18*b*. The upwardly extending arms 18*a*, 18*b* have removable plates 26*a*, 26*b* mounted thereon.

The side walls 10, 12, base 14, upper surface 16, front wall 30 and rear wall 32 of the body provide an enclosure or casing for the securing means 8.

The securing means 8 includes a first over-center mechanism 36*a* and a first locking member 38*a*. The first over-center mechanism 36*a* includes a first link 40*a* and a first pivotable member 42*a*.

Figure 17:
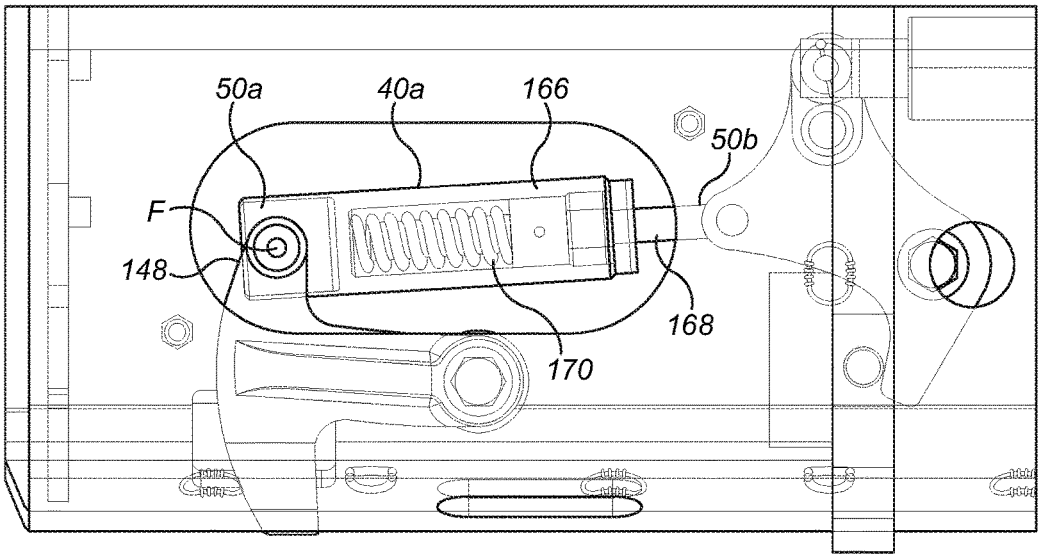
FIG. 17 is a rear view of the quick hitch of FIGS. 1 to 4 with the locking member in a fully engaged position.
Figure 18:
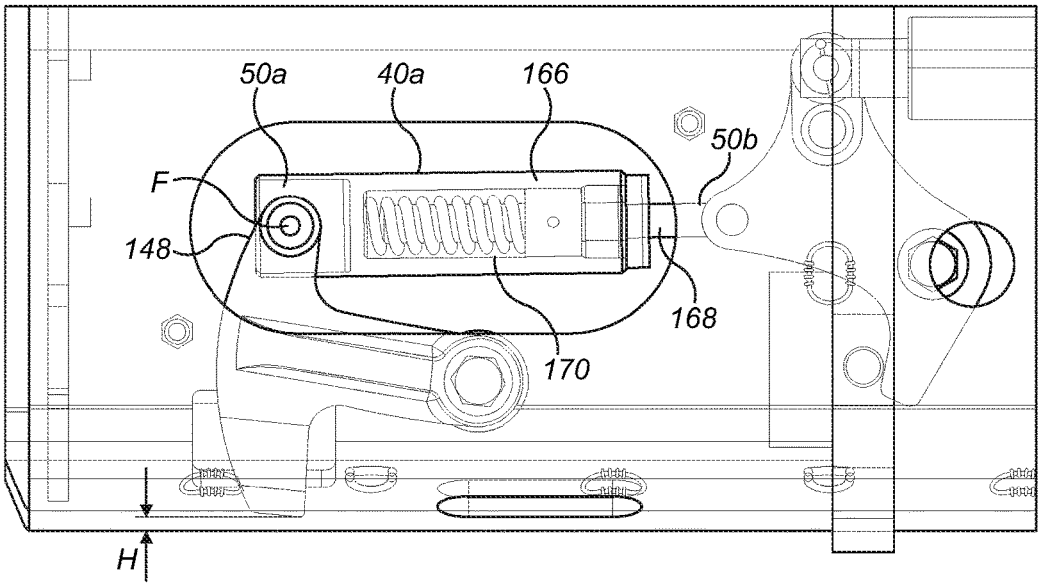
FIG. 18 is a rear view of the quick hitch of FIGS. 1 to 4 with the locking member in a partially engaged position.

The first link 40*a* has a first end 50*a* and a second end 50*b*. The first end 50*a* has a pivot 148 which has an axis F. As shown in FIGS. 17 and 18, the first link 40*a* is a resilient link and has a hollow cylindrical body 166, a piston member 168 and a spring 170.

The first pivotable member 42*a* includes a first arm 52, a second arm 54 and a third arm 55. The first arm 52 has a pivot 150 which has an axis E.

The first locking member 38*a* includes a first projection 48*a*.

The securing means 8 includes a second over-center mechanism 36*b* and a second locking member 38*b*. The second over-center mechanism 36*b* includes a second first link 40*b* and a second first pivotable member 42*b*.

The second first link 40*b* has a first end 62*a* and a second end 62*b*. The first end 62*a* has a pivot 156 which has an axis F'. Similarly to the first link 40*a*, the second first link 40*b* is a resilient link and has a hollow cylindrical body 172, a piston member 174 and a spring (not shown).

The second first pivotable member 42*b* includes a first arm 64, a second arm 66 and a third arm 67. The first arm 64 has a pivot 158 which has an axis E'.

The second locking member 38*b* includes a second projection 48*b*.

The securing means 8 further includes a second link 44*a* and a second second link 44*b*.

The second link 44*a* has a first end 56*a* and a second end 56*b*. The first end 56*a* has a pivot 152 which has an axis A. The second end 56*b* has a pivot 154 which has an axis B.

The second second link 44*b* has a first end 68*a* and a second end 68*b*. The first end 68*a* has a pivot 160 which has an axis A'. The second end 68*b* has a pivot 162 which has an axis B'.

The securing means 8 further includes a second pivotable means 46. The second pivotable member 46 has a first end 58*a*, a second end 58*b* and a plate 69.

The plate 69 has a first end 65*a* and a second end 65*b*. The plate 69 also has three holes 164*a*, 164*b*, 164*c*. Hole 164*a* is located adjacent to the first end 65*a* of the plate 69, hole 164*c* is located adjacent to the second end 65*b* of the plate 69 and hole 164*b* is located between hole 164*a* and 164*c* along the length of the plate 69.

Assembly of the securing means 8 of the quick hitch 2 of the first embodiment will now be described.

The first over-center mechanism 36*a* is assembled as follows.

The first pivotable member 42*a* is pivotably mounted at pivot 140 such that the first pivotable member 42*a* is able to pivot relative to the chassis of the quick hitch 2 about axis D. The second end 50*b* of the first link 40*a* is pivotably mounted to the first arm 52 of the first pivotable member 42*a* such that the first link 40*a* and the first pivotable member 42*a* are able to pivot relative to each other about axis E. The first end 50*a* of the first link 40*a* is pivotably mounted to the first locking member 38*a* such that the first link 40*a* and the first locking member 38*a* are able to pivot relative to each other about axis F. The first locking member 38*a* is pivotably mounted at pivot 138 such that the first locking member 38*a* is able to pivot relative to the chassis of the quick hitch 2 about axis G.

The second over-center mechanism 36*b* is assembled as follows.

The second first pivotable member 42*b* is pivotably mounted at pivot 144 such that the second first pivotable member 42*b* is able to pivot relative to the chassis of the quick hitch about axis D'. The second end 62*b* of the second first link 40*b* is pivotably mounted to the first arm 64 of the second first pivotable member 42*b* at pivot 158 such that the second first link 40*b* and the second first pivotable member 42*b* can pivot relative to each other about axis E'. The first end end 62*a* of the second first link 40*b* is pivotably mounted to the second locking member 38*b* at pivot 156 such that the second first link 40*b* and the second locking member 38*b* can pivot relative to each other about axis F'. The second locking member 38*b* is pivotably mounted at pivot 146 such that the second locking member 38*b* is able to pivot relative to the chassis of the quick hitch 2 about axis G'.

The second end 58*b* of the second pivotable member 46 and central hole 164*b* of plate 69 are mounted on pivot 142 such that the second pivotable member 46 and the plate 69 can rotate about axis C.

The first over-center mechanism 36*a* is linked to the second pivotable member 46 and the plate 69 by second link 44*a*. The third arm 55 of the first pivotable member 42*a* is pivotally mounted to the first end 56*a* of the second link 44*a* such that the first pivotable member 42*a* and the second link 44*a* can pivot relative to each other about axis A. The second end 56*b* of second link 44*a* is mounted on hole 164*a* at the first end 65*a* of the plate 69 at pivot 154 such that the second end 56*b* of the second link 44*a* can pivot about axis C.

The second over-center mechanism 36*b* is linked to the second pivotable member 46 by second second link 44*b*. The third arm 67 of the second first pivotable member 42*b* is pivotally mounted to the first end 68*a* of the second second link 44*b* such that the second first pivotable member 42*b* and the second second link 44*b* can pivot relative to each other about axis A'. The second end 68*b* of the second second link 44*b* is mounted on hole 164*c* at the second end 65*b* of the plate 69 at pivot 162 such that the second second link 44*b* can pivot about axis C.

The body 4 is partially constructed by assembling the front wall 30, the side walls 10, 12, the base 14 and the upper surface 16.

The securing means 8 is placed within the partially constructed body 4 such that the first end 68*a* of the second pivotable member 46 extends through the opening 20 in the upper surface 16, the first projection 48*a* of the first locking member 38*a* is positioned adjacent to aperture 28*a* in the base 14 and the second projection 48*b* of the second locking member 38*b* is positioned adjacent to aperture 28*b* in the base 14.

The rear wall 30 is then mounted to the side walls 10, 12, the base 14 and the upper surface 16 to complete the body 4.

Plate 22 is mounted on the upper surface 16 of the body 4 using fasteners 60 such that the opening 24 of the plate 22 corresponds to the opening 20 of the upper surface 16 and the first end 68*a* of the second pivotable member 46 extends through opening 20 in the upper surface 16, the brushes (not shown) and opening 24 in the plate 22.

Removable plate 26*a* is mounted on upper arm 18*a* using fasteners 27. In the same way, removable plate 26*b* is mounted on upper arm 18*b* using fasteners 27.

Use of the quick hitch 2 to mount an implement, for example a shovel 180, as shown in FIGS. 3, 4, 7 and 8 on a machine (not shown) will now be described.

The quick hitch 2 is secured on the machine (not shown) with the rear wall 32 of the quick hitch 2 facing the front of the machine (not shown). The mounting means 6*a*, 6*c*, 6*c* are secured on complementary mounting means (not shown) on the machine (not shown) by pins (not shown).

The shovel 180 has a base 182, side walls 184*a*, 184*b* and a rear wall 186. The rear wall 186 has a lower lip 188, an upper lip 190 and an outer surface 192. The upper lip 190 has a lower surface 189.

The machine with the quick hitch 2 in the unlocked position (as shown in FIGS. 1 to 4) and the shovel 180 are brought into close proximity such that the front wall 30 of the quick hitch is adjacent to the outer surface 192 of the rear wall 186 of the shovel 180. The upper arms 18*a*, 18*b* are positioned under the upper lip 190 such that the removable plates 26*a*, 26*b* are in contact with the lower surface 189 of the upper lip 190. The base 14 of the quick hitch is lined up with the lower lip 188 such that the apertures 28*a*, 28*b* are adjacent to the lower lip 188.

Figure 2:
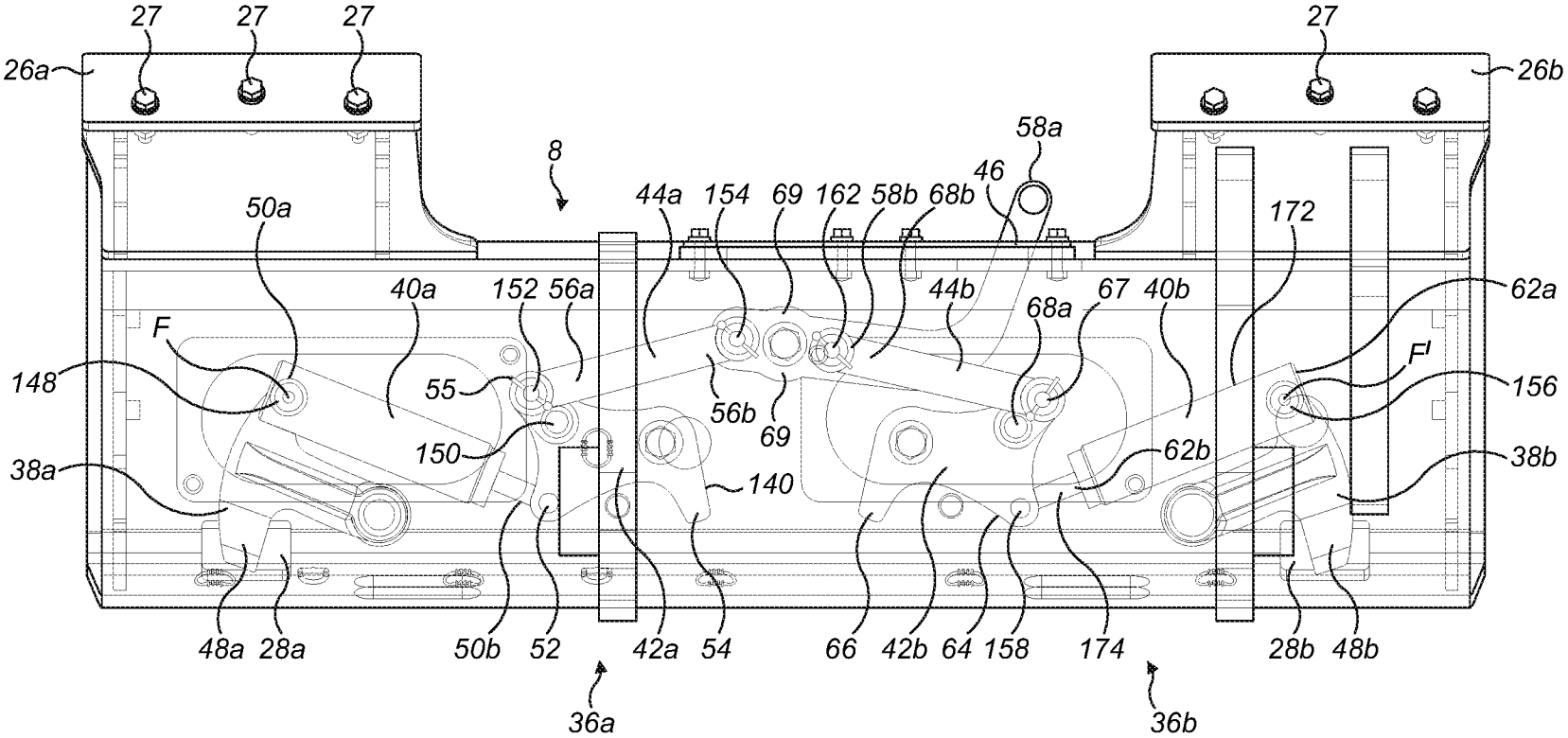
FIG. 2 is a rear view of the quick hitch of FIG. 1 in an unlocked position.
Figure 3:
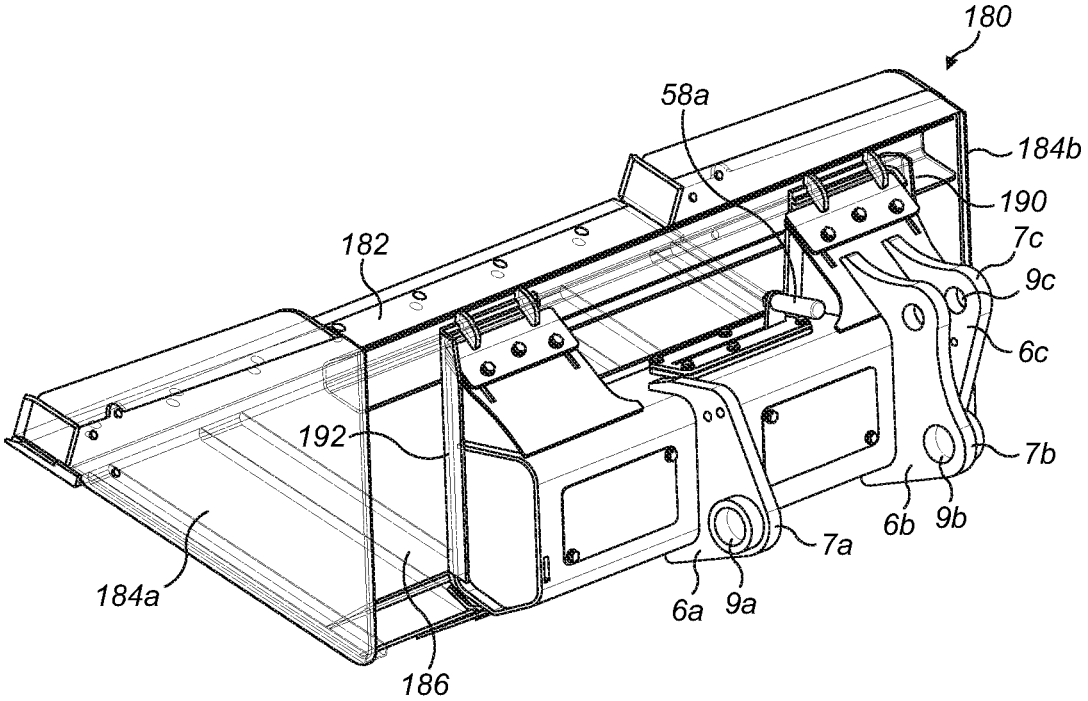
FIG. 3 is an isometric rear view of the quick hitch of FIGS. 1 and 2 connected to a shovel with the quick hitch in an unlocked position.
Figure 4:
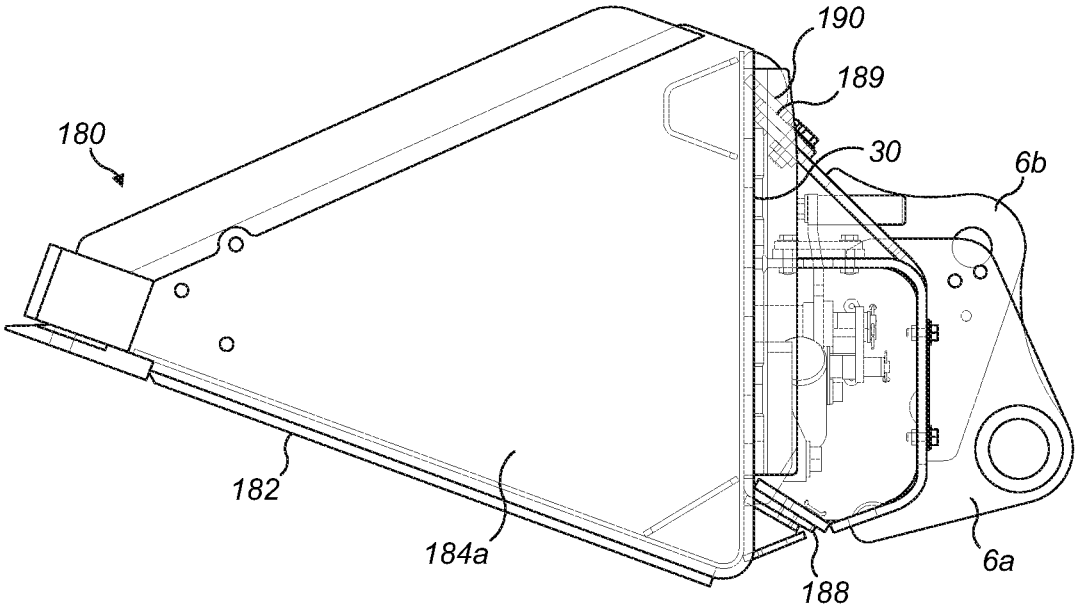
FIG. 4 is a side view of the quick hitch of FIGS. 1, 2 and 3 connected to a shovel with the quick hitch in an unlocked position.
Figure 5:
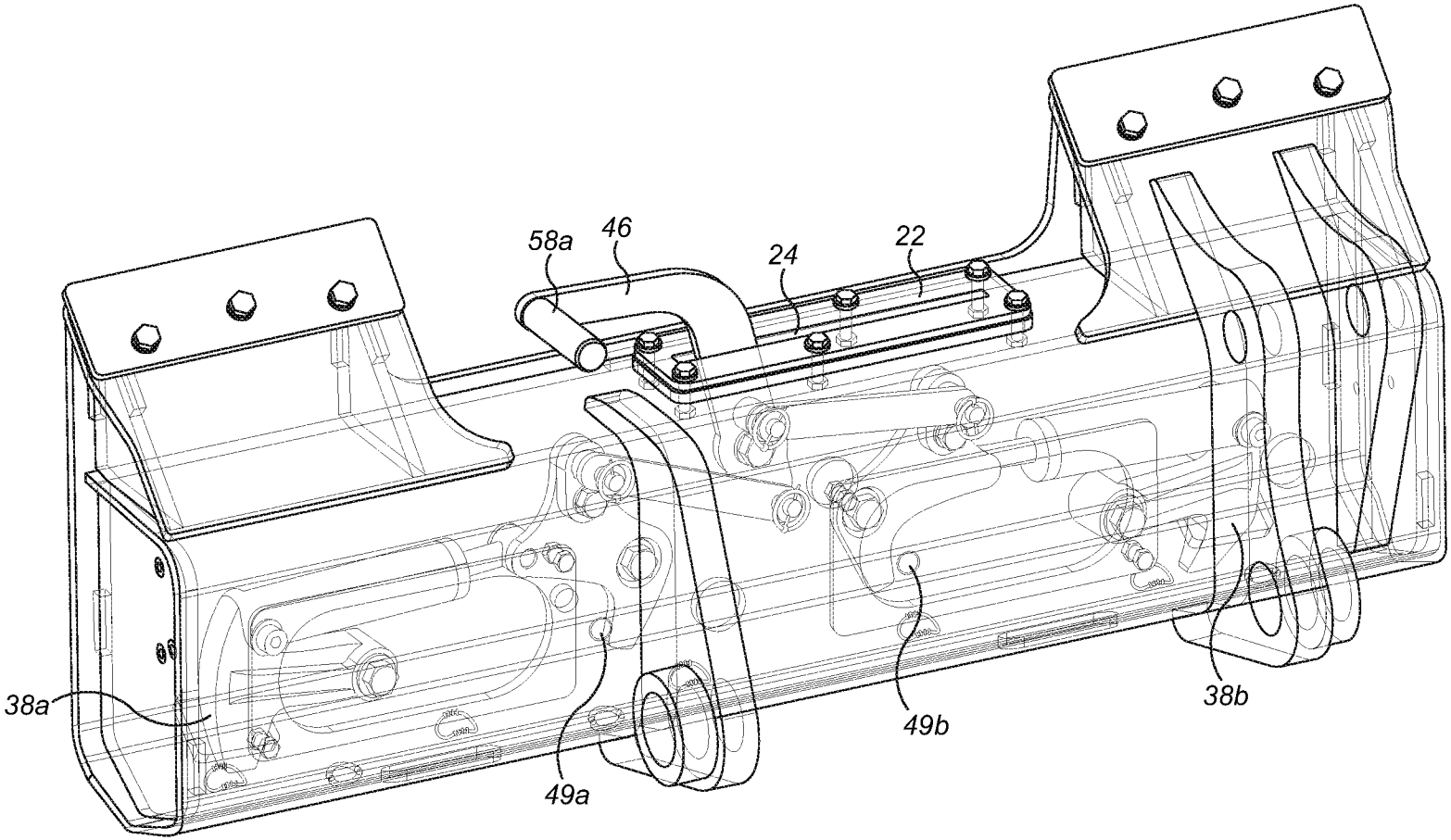
FIG. 5 is an isometric rear view of the quick hitch of FIGS. 1 to 4 in a locked position.
Figure 6:
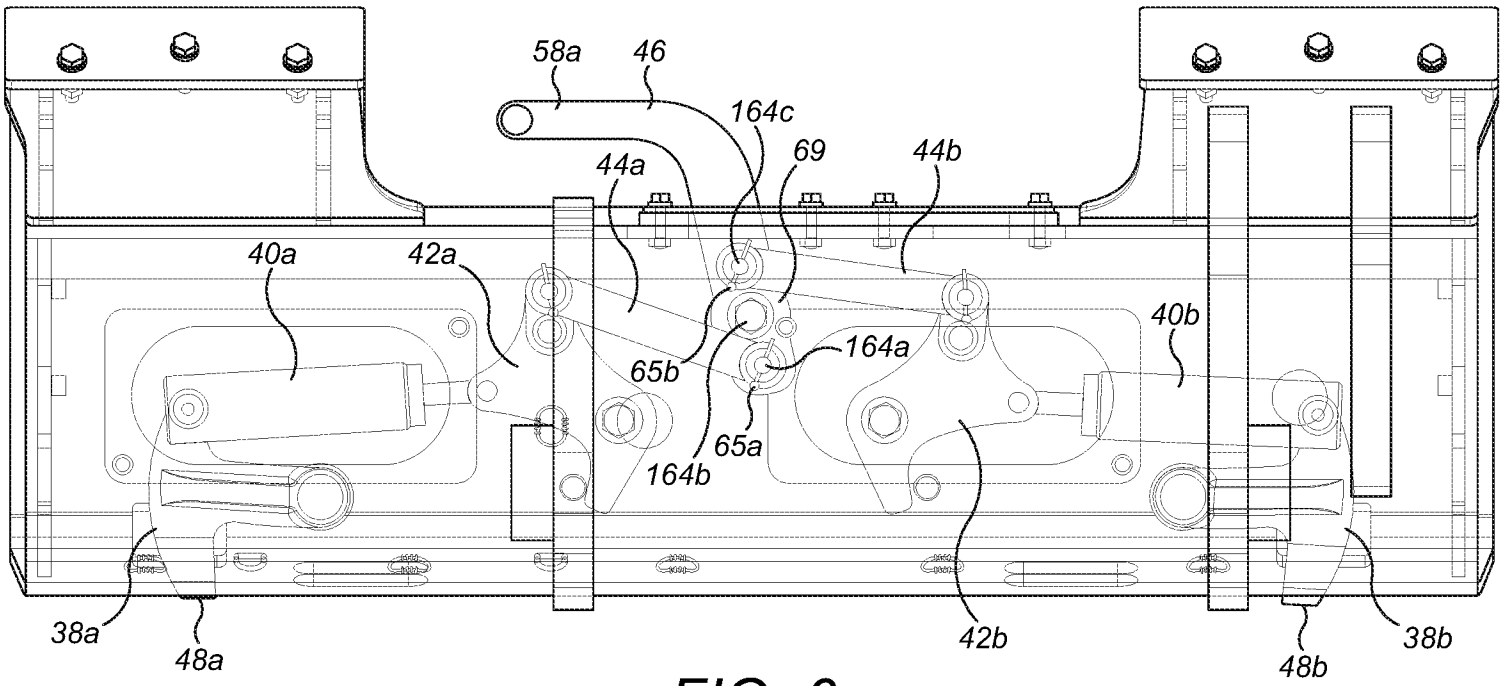
FIG. 6 is a rear view of the quick hitch of FIGS. 1 to 4 in a locked position.
Figure 7:
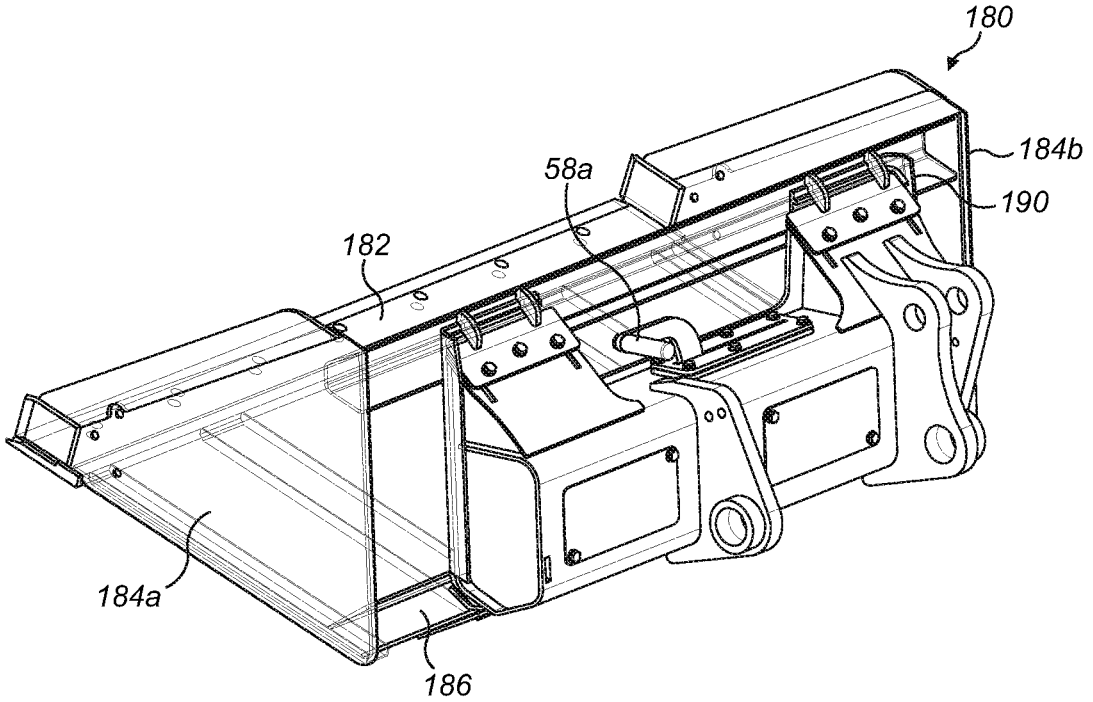
FIG. 7 is an isometric rear view of the quick hitch of FIGS. 1 to 4 connected to a shovel with the quick hitch in a locked position.
Figure 8:
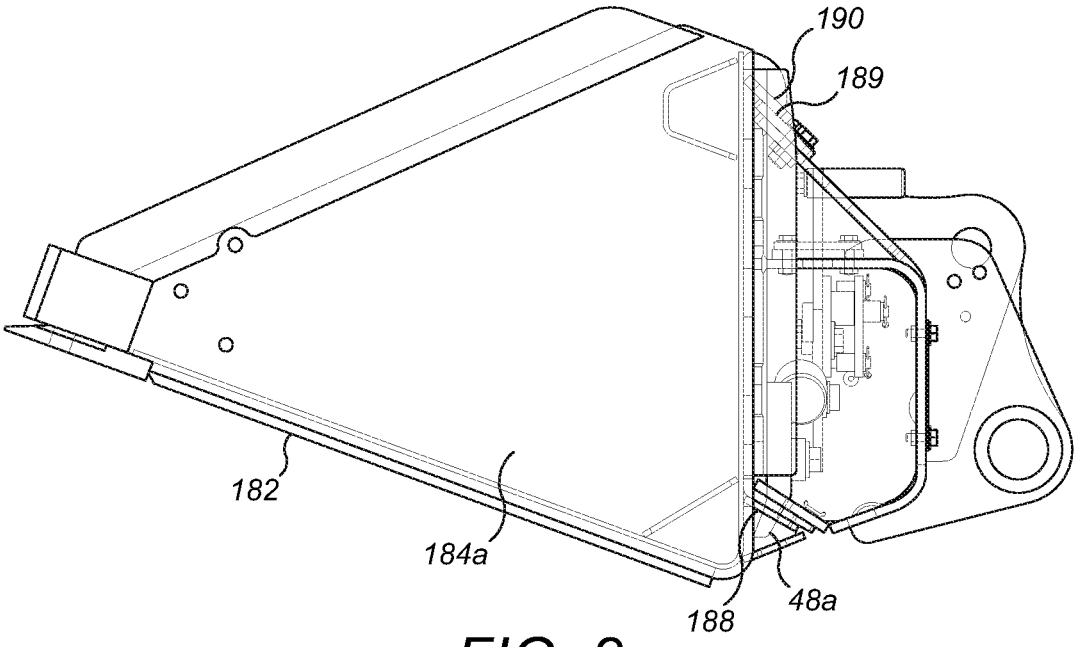
FIG. 8 is a side view of the quick hitch of FIGS. 1 to 4 connected to a shovel with the quick hitch in a locked position.

To lock the shovel 180 on the quick hitch 2, the first end 58*a* of the second pivotable member 46, which acts as a manual actuator or handle, is moved from the position shown in FIGS. 1 and 2 to the position shown in FIGS. 5 and 6. The first end 58*a* advantageously provides a single lever or handle for operating i.e. engaging and disengaging the quick hitch mechanism.

This causes the second end 58*b* of the second pivotable member 46, the second end 56*b* of the second link 44*a* and the second end 68*b* of the second second link 44*b* to be pivoted anticlockwise about axis C.

The pivoting movement of the second end 56*b* of the second link 44*a* about pivot C causes the first end 56*a* of the second link 44*a* and the third arm 55 of the first pivotable member 42*a* to pivot clockwise relative to axis A, the second arm 54 of the first pivotable member 42*a* to pivot clockwise relative to axis D and the first arm 52 of the first pivotable member 42*a* to pivot clockwise relative to axis E.

The distance travelled by the second arm 54 of the first pivotable member 42*a* is limited by pin 49*a* against which the second arm 54 abuts when the securing means 8 is in the locked position.

The pivoting movement of the first pivotable member 42*a* causes the second end 50*b* of the first link 40*a* to pivot anticlockwise relative to axis E and the first end 50*a* of the first link 40*a* to pivot anticlockwise relative to axis F.

The pivoting movement of the first link 40*a* causes the first locking member 38*a* to pivot anticlockwise relative to axis F which causes the first projection 48*a* to move downward and to extend through aperture 28*a* in the base 14.

The first projection 48*a* engages the lower lip 188 of the shovel 180 to lock the shovel 180 to the quick hitch 2.

When the securing means 8 is in the locked position, upward movement of the first projection 48*a* is restricted by the resilient link 40*a*.

The pivoting movement of the second end 68*b* of the second second link 44*b* about pivot C causes the first end 68*a* of the second second link 44*b* and the third arm 67 of the second first pivotable member 42*b* to pivot anticlockwise relative to axis A', the second arm 66 of the second first pivotable member 42*b* to pivot anticlockwise relative to axis D' and the first arm 64 of the second first pivotable member 42*b* to pivot anticlockwise relative to axis E'.

The distance travelled by the second arm 66 of the second first pivotable member 42*b* is limited by pin 49*b* against which it abuts.

The pivoting movement of the second first pivotable member 42*b* causes the second end 62*b* of the second first link 40*b* to pivot anticlockwise relative to axis E' and the first end 62*a* of the second first link 40*b* to pivot clockwise relative to axis F'.

The pivoting movement of the second first link 40*b* causes the second locking member 38*b* to pivot clockwise relative to axis F' which causes the second projection 48*b* to move downward and to extend through aperture 28*b* in the base 14.

The second projection 48*b* engages the lower lip 188 of the shovel 180 to lock the shovel 180 to the quick hitch 2.

When the securing means 8 is in the locked position, upward movement of the second projection 48*b* is restricted by the resilient link 40*b*.

Figure 21:
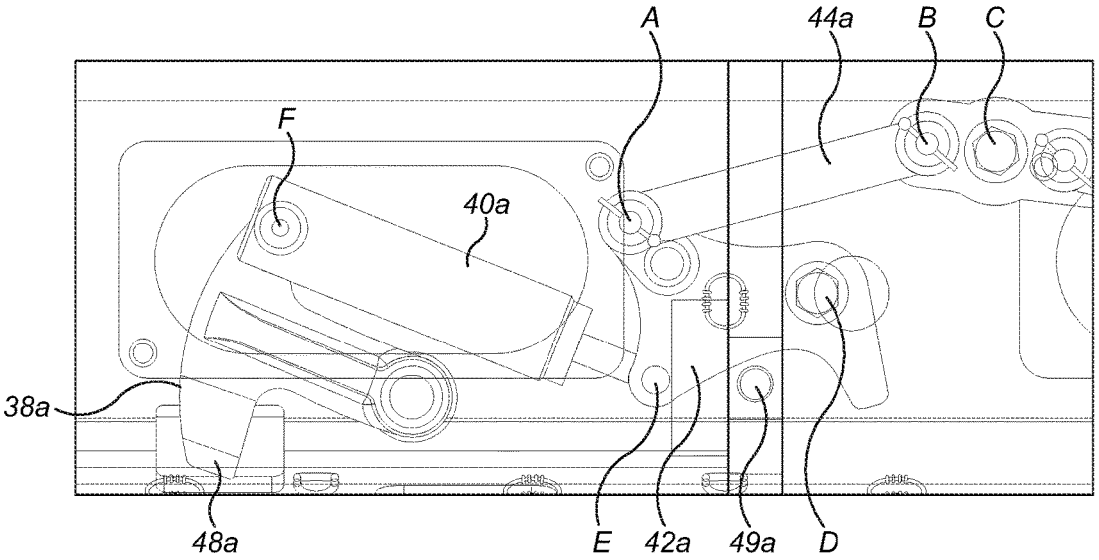
FIG. 21 is a rear view of the first over-center mechanism of the quick hitch of FIGS. 1 to 4 in an unlocked position.
Figure 22:
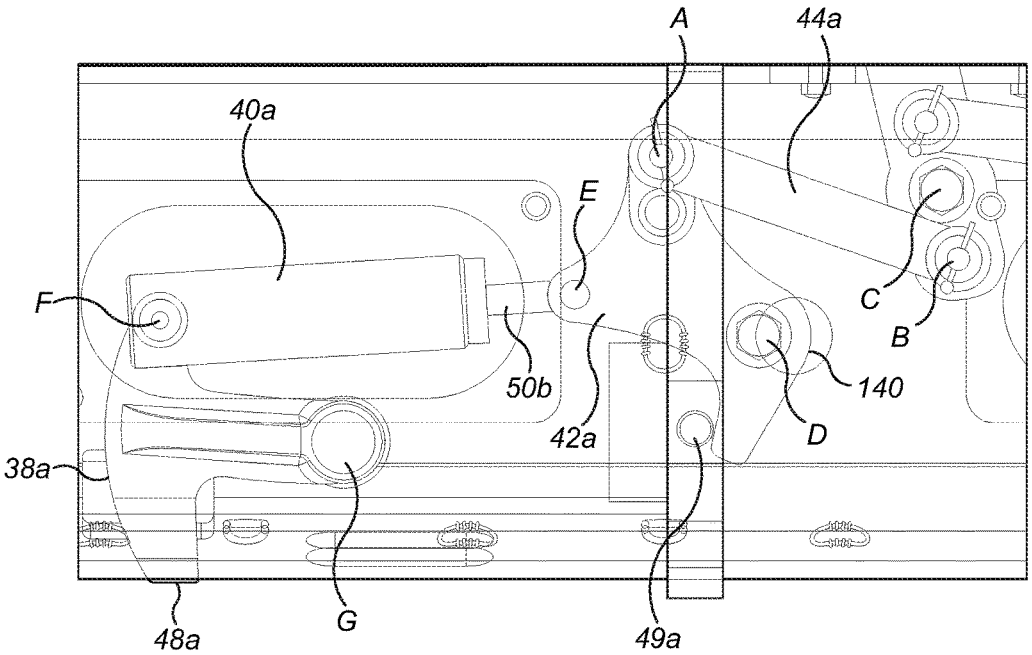
FIG. 22 is a rear view of the first over-center mechanism of the quick hitch of FIGS. 1 to 4 in a locked position.

When the quick hitch 2 is secured to the shovel 180 (as shown in FIG. 21) axis E of the first over-center mechanism 36*a* lies on a first side of a straight line drawn between axes D and F and when the quick hitch is not secured to the shovel (as shown in FIG. 22) axis E lies on a second side of a straight line drawn between axes D and F. In a similar way (not shown in the Figures) axis E' of the second over-center mechanism 36*b* lies on a first side of a straight line drawn between axes D' and F' when the quick hitch 2 is secured to the shovel 180 and when the quick hitch 2 is not secured to the shovel 180, axis E' lies on a second side of a straight line drawn between axes D' and F'.

In this way the first and second projections 48*a*, 48*b* are preventing from pushing against the second pivotable member 46 when they are in the locked position.

The inclusion of a resilient, or spring-loaded, first link 40*a* on one side of the securing means and a second first link 40*b* on a second side of the securing means 8 ensures positive engagement of the first and second projections 48*a*, 48*b* and keeps the securing means 8 in compression to prevent the securing means 8 from ratting, which may result in the first and second projections 48*a*, 48*b* disengaging from the lower lip 188 of the shovel 180.

The inclusion of the solid piston or plunger 168 in a hollow cylindrical body 166 having a spring 170 limits the upward movement of the first and second projections 48*a*, 48*b* to no more than 15 millimeters when the second pivotable member 46 and securing means 8 are in the locked position. This ensures attachment engagement at all times when the second pivotable member 46 and securing means 8 are in the locked position.

The position of the second pivotable means 46 through the opening 20 in the upper surface 16 and the opening 24 in the plate 22 when the quick hitch 2 is in the unlocked position compared to the position of the second pivotable means 46 through the opening 20 in the upper surface 16 and the opening 24 in the plate 22 when the quick hitch 2 is in the locked position indicates to an operator whether or not the shovel 180 is secured on the quick hitch 2.

The provision of the body 4 to enclose the securing means prevents damage being caused to the securing means 8 by dirt and debris. The provision of brushes (not shown) within the opening 24 of the plate further prevents the ingress of dirt and debris into the body 4 of the quick hitch 2.

The provision of removable plates 26*a*, 26*b* on the arm portions 18*a*, 18*b* which engage the lower surface 189 of the upper lip 190 of the shovel 180 increase the lifecycle of the quick hitch as the plates 26*a*, 26*b* can be removed from the quick hitch 2 when worn and replaced with new, unworn, plates.

Referring now to FIGS. 9 to 16, 9, 20, 23 and 24, there is shown a quick hitch 202 according to a second embodiment of the invention.

FIGS. 9 to 12 and 23 show the quick hitch 202 in an unlocked position and FIGS. 13 to 16 and 24 show the quick hitch 202 in a locked position.

The quick hitch 202 has a body 4, mounting means 6*a*, 6*b*, 6*c* for mounting the quick hitch 202 on a machine and securing means 208 for securing an implement to the quick hitch 2.

The quick hitch 202 also includes a first pin 49*a*, second pin 49*b*, a third pin 249*c* and pivots 138, 140, 142, 144, 146. Each of the first pin 49*a*, second pin 49*b* and pivot 138 which has an axis G", pivot 140 which has an axis D", pivot 142 which has an axis C", pivot 144 which has an axis D"', pivot 146 which has an axis G"' are mounted on a chassis of the quick hitch 202.

The body 4 has side walls 10, 12, a base 14, an upper surface 16, a front wall 30 and a rear wall 32.

The base 14 has a pair of apertures 28*a*, 28*b*.

The upper surface 16 has an opening 20 and a plate 22. The plate 22 has an opening 24 that corresponds to the opening 20 in the upper surface 16. The plate 22 has brushes (not shown) within the opening 24.

The front wall 30 is generally U-shaped.

The rear wall 32 includes a pair of access doors 34*a*, 34*b*. The mounting means 6*a*, 6*b*, 6*c* are mounted on the rear wall 32 and have lugs 7*a*, 7*b*, 7*c*, with apertures 9*a*, 9*b*, 9*c* for receiving supporting pins (not shown). The rear wall 32 also includes a pair of upwardly extending arms 18*a*, 18*b*. The upwardly extending arms 18*a*, 18*b* have removable plates 26*a*, 26*b* mounted thereon.

The side walls 10, 12, base 14, upper surface 16, front wall 30 and rear wall 32 of the body provide an enclosure or casing for the securing means 208.

The securing means 208 includes a first over-center mechanism 236*a* and a first locking member 238*a*. The first over-center mechanism 236*a* includes a first link 240*a* and a first pivotable member 242*a*.

The first link 240*a* has a first end 250*a* and a second end 250*b*. The first end 250*a* has a pivot 348 which has an axis F". The first link 240*a* is a resilient link and (as shown in FIGS. 17 and 18 in relation the first link 40*a* of the first embodiment) has a hollow cylindrical body 166, a piston member 168 and a spring 170.

Figure 20:
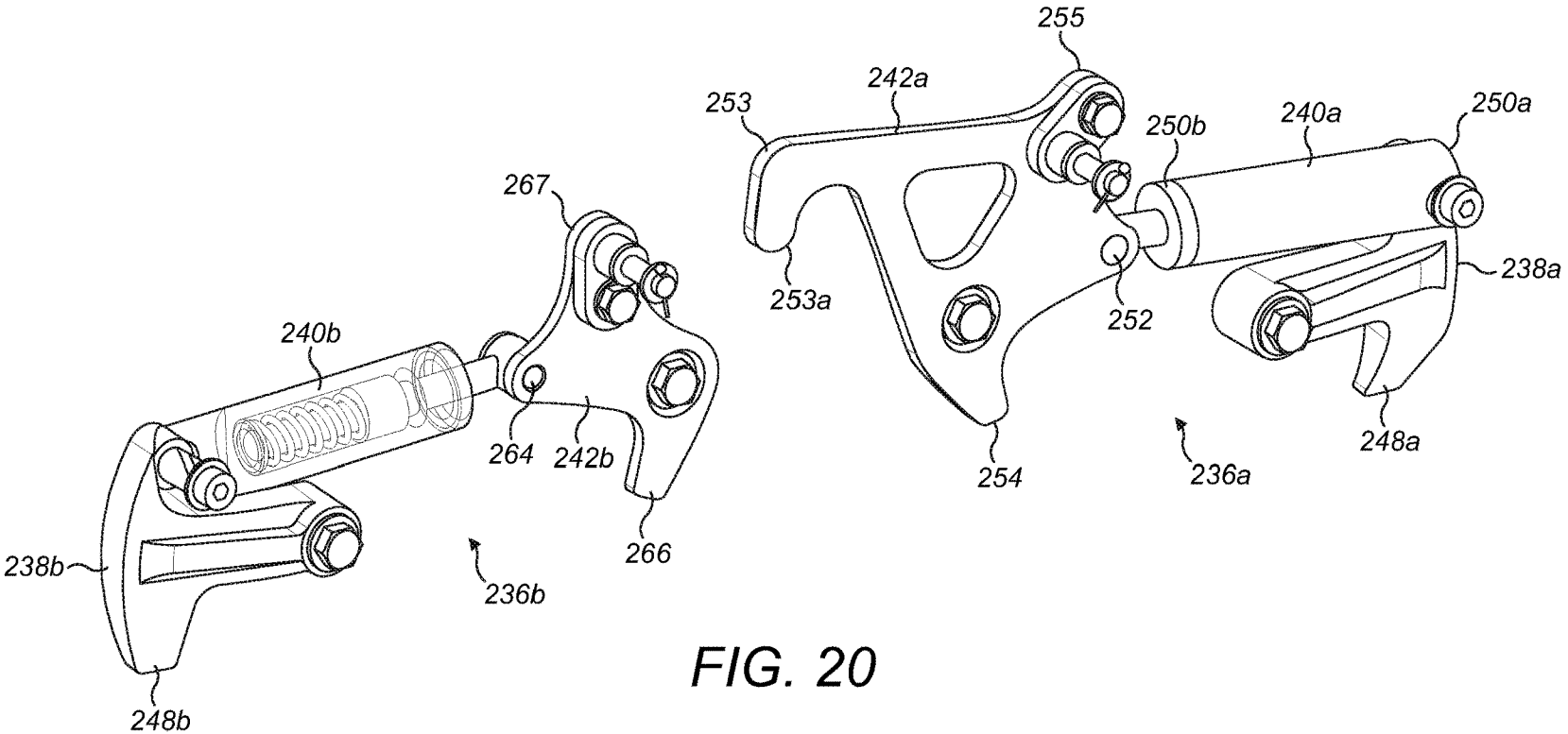
FIG. 20 is a rear view of the securing means of FIG. 19 without an actuator.

As shown in FIG. 20, the first pivotable member 242*a* includes a first arm 252, a second arm 254, a third arm 255 and a leg 253. The first arm 252 has a pivot 350 which has an axis E". The leg 253 has a hook portion 253*a*.

The first locking member 238*a* includes a first projection 248*a*.

The securing means 208 includes a second over-center mechanism 236*b* and a second locking member 238*b*. The second over-center mechanism 236*b* includes a second first link 240*b* and a second first pivotable member 242*b*.

The second first link 240*b* has a first end 262*a* and a second end 262*b*. The first end 262*a* has a pivot 356 which has an axis F". Similarly to the first link 240*a*, the second first link 240*b* is a resilient link and has a hollow cylindrical body 372, a piston member 374 and a spring (not shown).

The second first pivotable member 242*b* includes a first arm 264, a second arm 266 and a third arm 267. The first arm 264 has a pivot 358 which has an axis E".

The second locking member 238*b* includes a second projection 248*b*.

Figure 19:
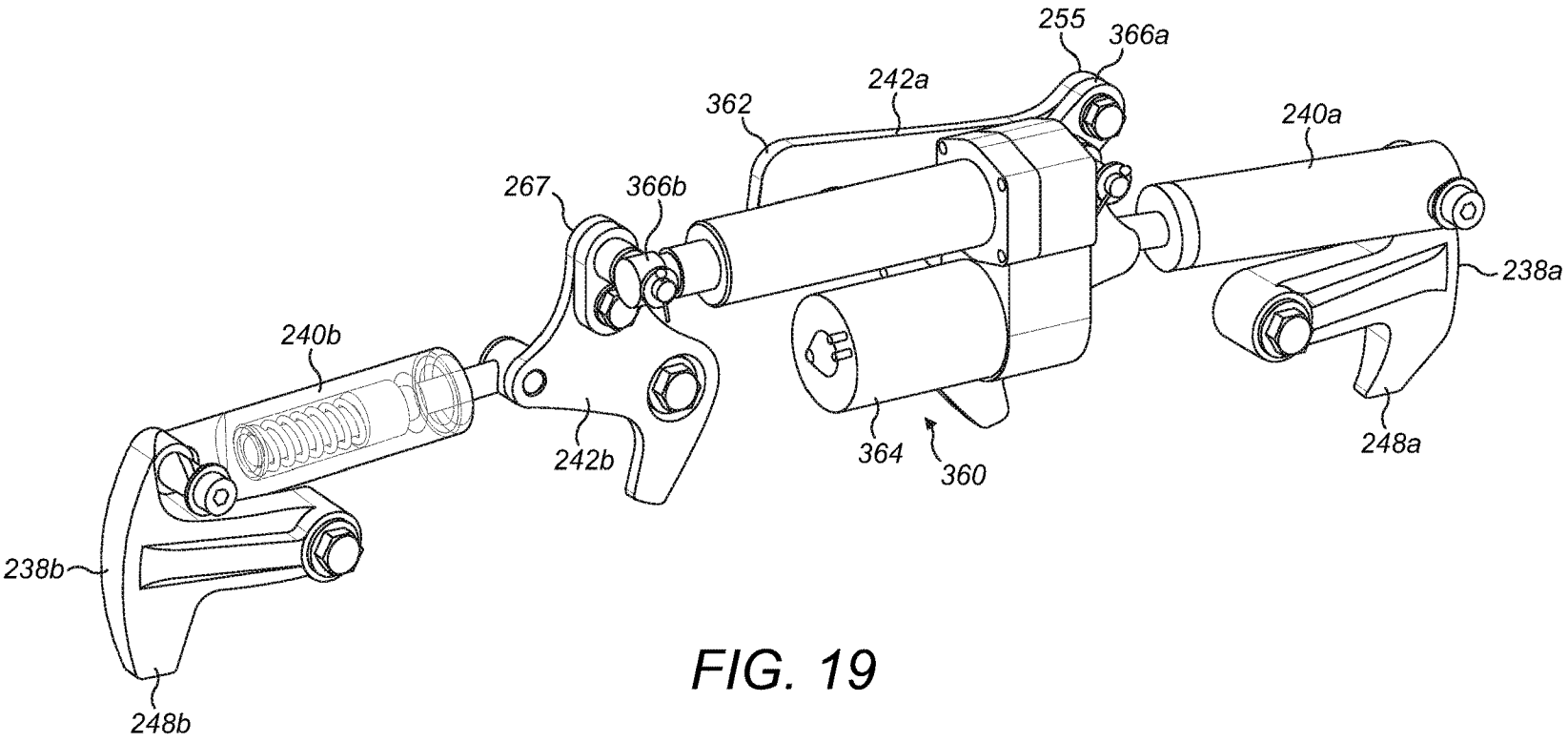
FIG. 19 is a rear view of the securing means of the quick hitch of FIGS. 9 to 12 with an actuator.

The securing means 208 further includes an actuator 360. As shown more clearly in FIG. 19, the actuator 360 has a screw actuator 362 and a motor 364. The screw actuator 362 has a first end 366*a* and a second end 366*b*.

Assembly of the securing means 208 of the quick hitch 202 of the second embodiment will now be described.

The first over-center mechanism 236*a* is assembled as follows.

The first pivotable member 242*a* is pivotably mounted at pivot 340 such that the first pivotable member 242*a* is able to pivot relative to the chassis of the quick hitch 202 about axis D". The second end 250*b* of the first link 240*a* is pivotably mounted to the first arm 252 of the first pivotable member 242*a* such that the first link 240*a* and the first pivotable member 242*a* are able to pivot relative to each other about axis E". The first end 250*a* of the first link 240*a* is pivotably mounted to the first locking member 238*a* such that the first link 240*a* and the first locking member 238*a* are able to pivot relative to each other about axis F". The first locking member 238*a* is pivotably mounted at pivot 338 such that the first locking member 238*a* is able to pivot relative to the chassis of the quick hitch 202 about axis G".

The second over-center mechanism 236*b* is assembled as follows.

The second first pivotable member 242*b* is pivotably mounted at pivot 344 such that the second first pivotable member 242*b* is able to pivot relative to the chassis of the quick hitch about axis Dm. The second end 262*b* of the second first link 240*b* is pivotably mounted to the first arm 264 of the second first pivotable member 242*b* at pivot 358 such that the second first link 240*b* and the second first pivotable member 242*b* can pivot relative to each other about axis E". The first end 262*a* of the second first link 240*b* is pivotably mounted to the second locking member 238*b* at pivot 356 such that the second first link 240*b* and the second locking member 238*b* can pivot relative to each other about axis F'''. The second locking member 238*b* is pivotably mounted at pivot 346 such that the second locking member 238*b* is able to pivot relative to the chassis of the quick hitch 202 about axis G'''.

The first over-center mechanism 236*a* is linked to the second over-center mechanism 236*b* by the actuator 360. The second arm 255 of the first pivotable member 242*a* is mounted on the first end 366*a* of the screw actuator 360. The third arm 267 of the second first pivotable member 242*b* is mounted on the second end 366*b* of the screw actuator 362.

The body 4 is partially constructed by assembling the front wall 30, the side walls 10, 12, the base 14 and the upper surface 16.

The securing means 208 is placed within the partially constructed body 4 such that the leg 253 of the first pivotable member 242*a* extends through the opening 20 in the upper surface 16, the first projection 248*a* of the first locking member 238*a* is positioned adjacent to aperture 28*a* in the base 14 and the second projection 248*b* of the second locking member 238*b* is positioned adjacent to aperture 28*b* in the base 14.

The rear wall 30 is then mounted to the side walls 10, 12, the base 14 and the upper surface 16 to complete the body 4.

Plate 22 is mounted on the upper surface 16 of the body 4 using fasteners 60 such that the opening 24 of the plate 22 corresponds to the opening 20 of the upper surface 16 and the leg 253 of the first pivotable member 242*a* extends through opening 20 in the upper surface 16, the brushes (not shown) and opening 24 in the plate 22.

Removable plate 26*a* is mounted on upper arm 18*a* using fasteners 27. In the same way, removable plate 26*b* is mounted on upper arm 18*b* using fasteners 27.

Use of the quick hitch 202 to mount an implement, for example a shovel 180, as shown in FIGS. 11, 12, 15 and 16 on a machine (not shown) will now be described.

The quick hitch 2 is secured on the machine (not shown) with the rear wall 32 of the quick hitch 2 facing the front of the machine (not shown). The mounting means 6*a*, 6*c*, 6*c* are secured on complementary mounting means (not shown) on the machine (not shown) by pins (not shown).

The shovel 180 has a base 182, side walls 184*a*, 184*b* and a rear wall 186. The rear wall 186 has a lower lip 188, an upper lip 190 and an outer surface 192. The upper lip 190 has a lower surface 189.

The machine with the quick hitch 202 in the unlocked position (as shown in FIGS. 9 to 12) and the shovel 180 are brought into close proximity such that the front wall 30 of the quick hitch 202 is adjacent to the outer surface 192 of the rear wall 186 of the shovel 180. The upper arms 18*a*, 18*b* are positioned under the upper lip 190 such that the removable plates 26*a*, 26*b* are in contact with the lower surface 189 of the upper lip 190. The base 14 of the quick hitch is lined up with the lower lip 188 such that the apertures 28*a*, 28*b* are adjacent to the lower lip 188.

Figure 9:
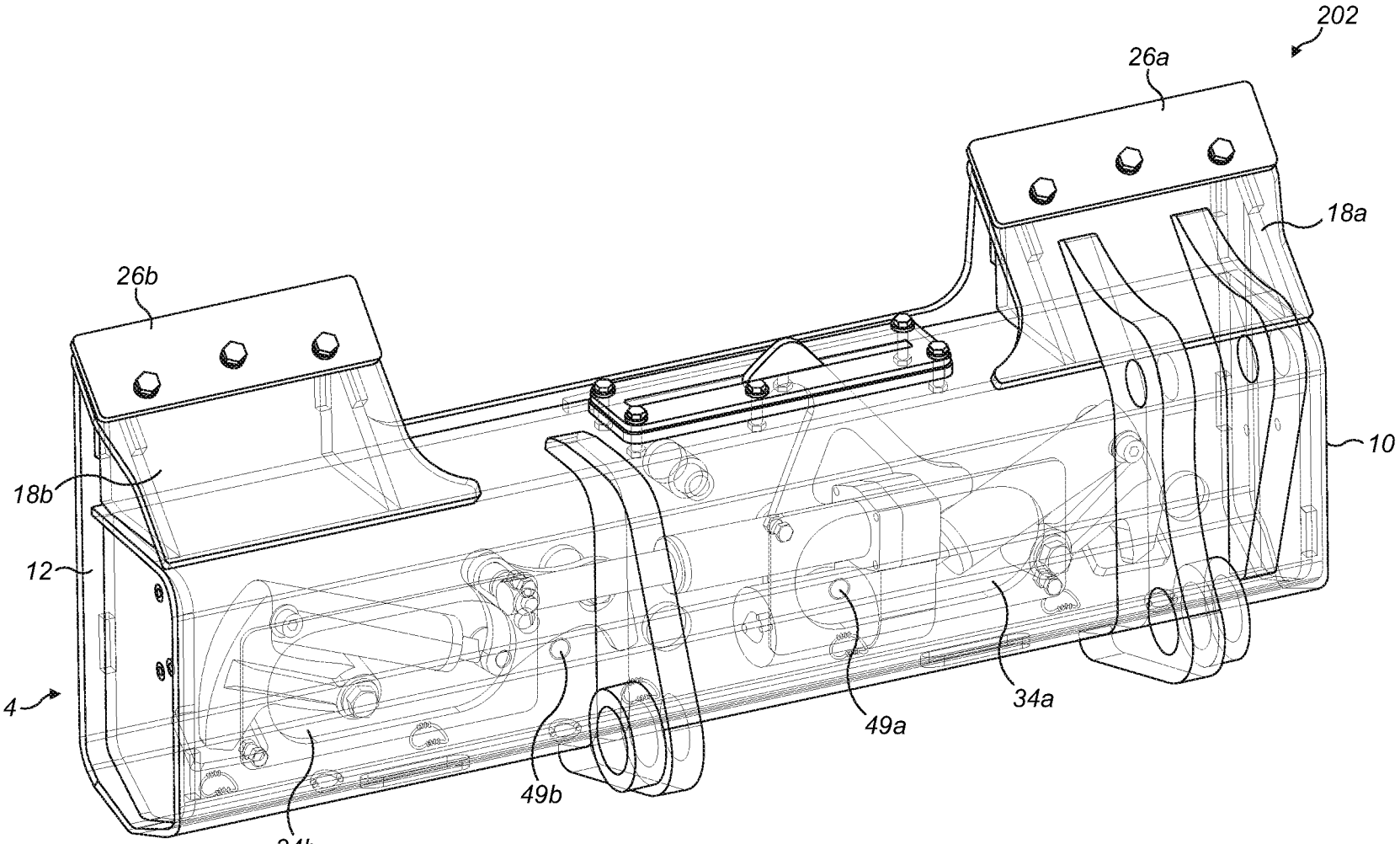
FIG. 9 is an isometric rear view of a quick hitch according to a second embodiment of the present invention in an unlocked position.
Figure 10:
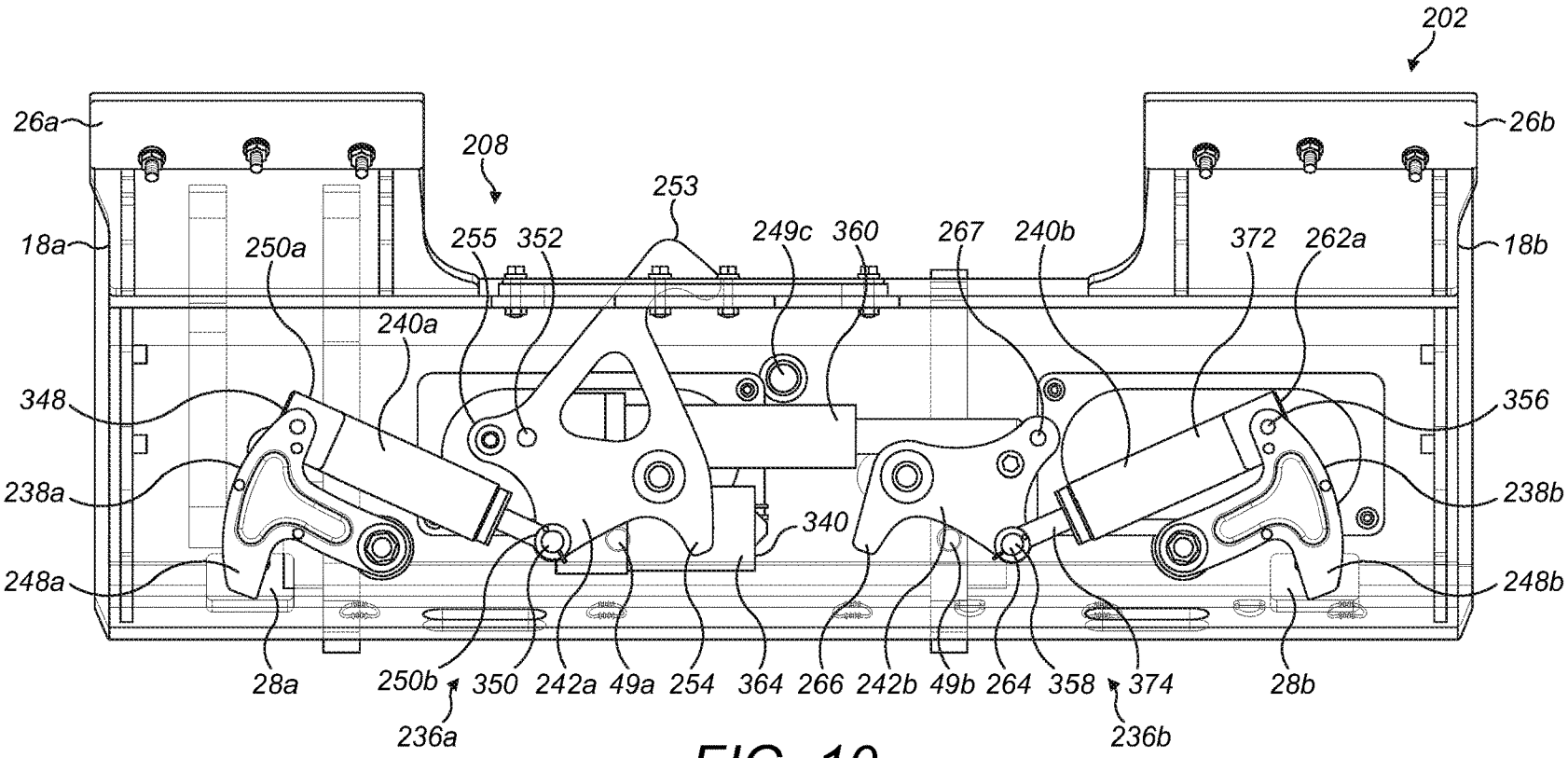
FIG. 10 is a front view of the quick hitch of FIG. 9 in an unlocked position.
Figure 11:
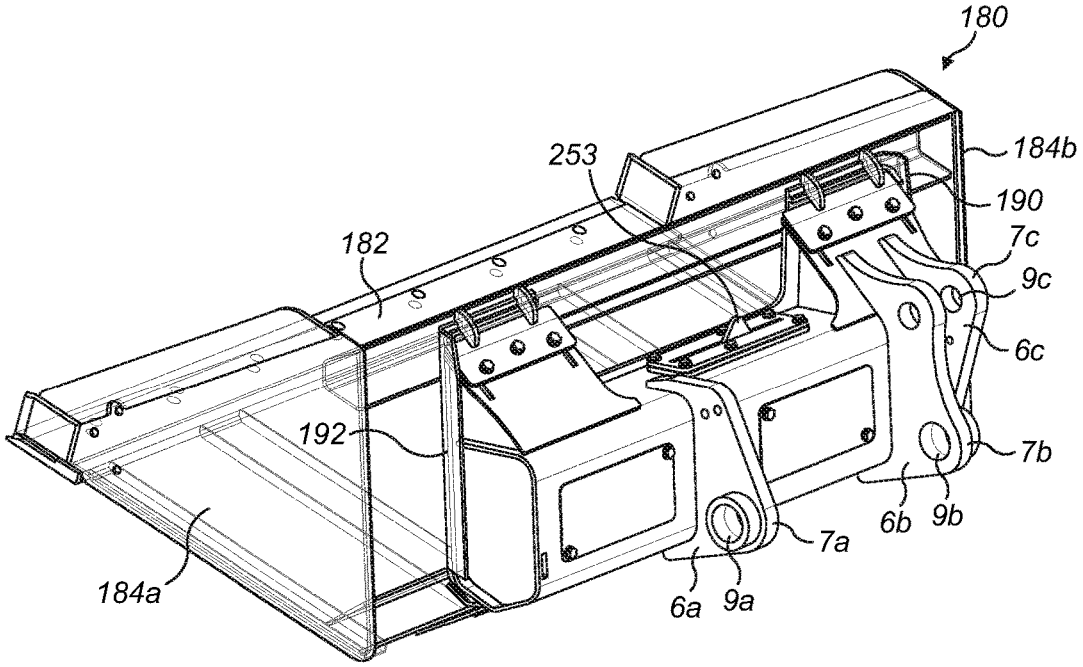
FIG. 11 is an isometric rear view of the quick hitch of FIGS. 9 and 10 connected to a shovel with the quick hitch in an unlocked position.
Figure 12:
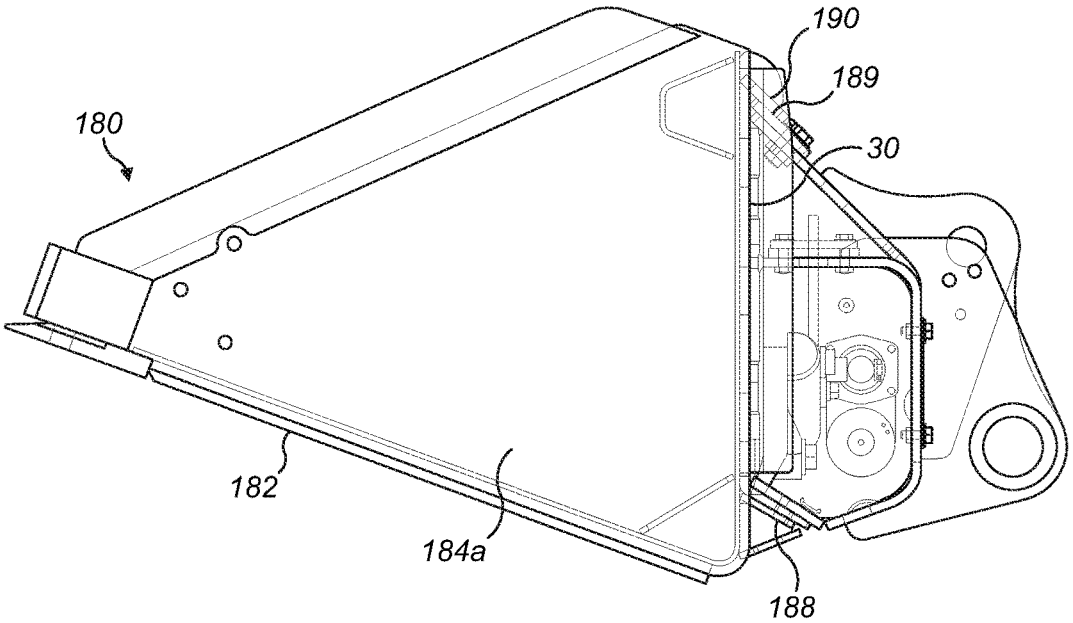
FIG. 12 is a side view of the quick hitch of FIGS. 9, 10 and 11 connected to a shovel with the quick hitch in an unlocked position.
Figure 13:
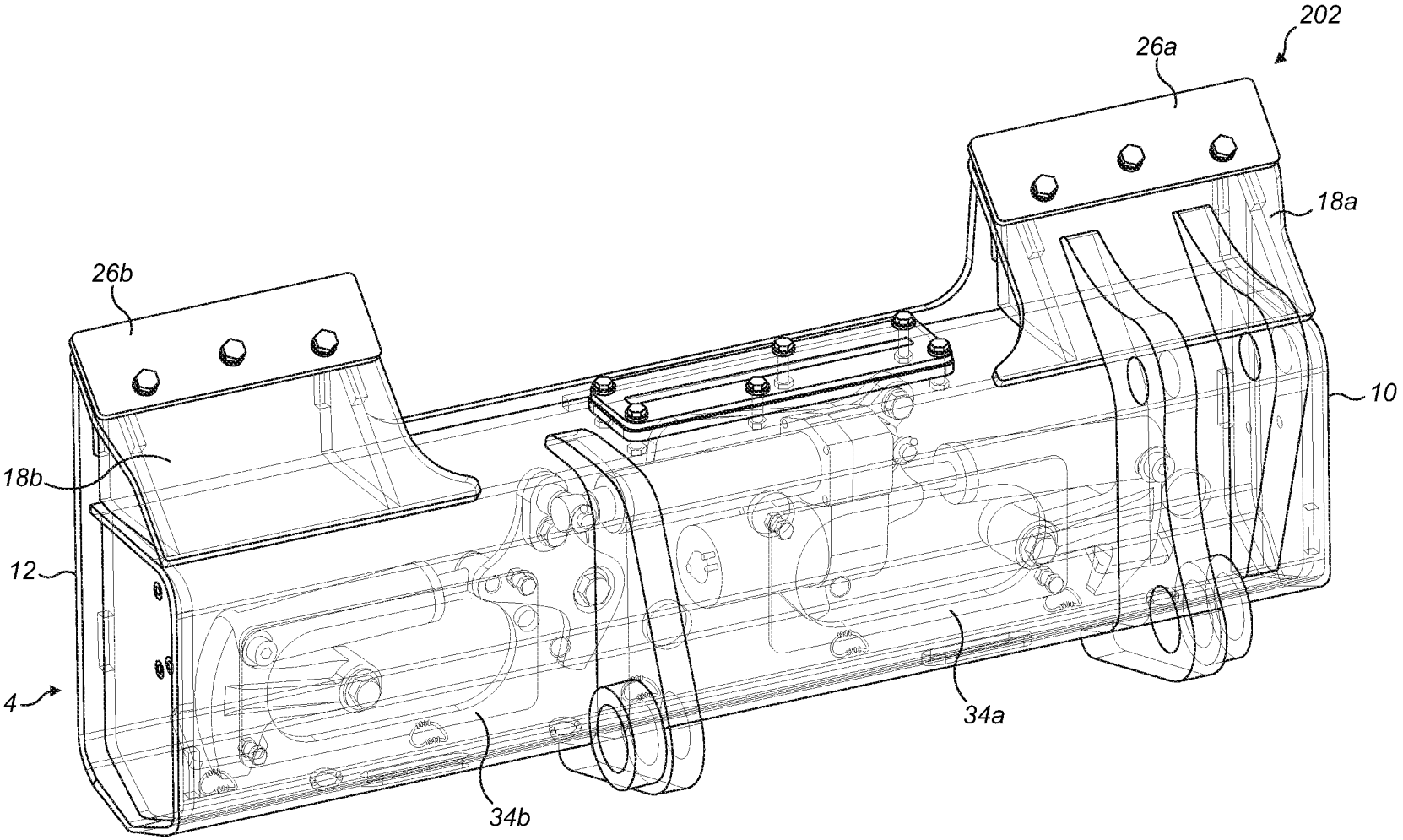
FIG. 13 is an isometric rear view of the quick hitch of FIGS. 9 to 12 in a locked position.
Figure 14:
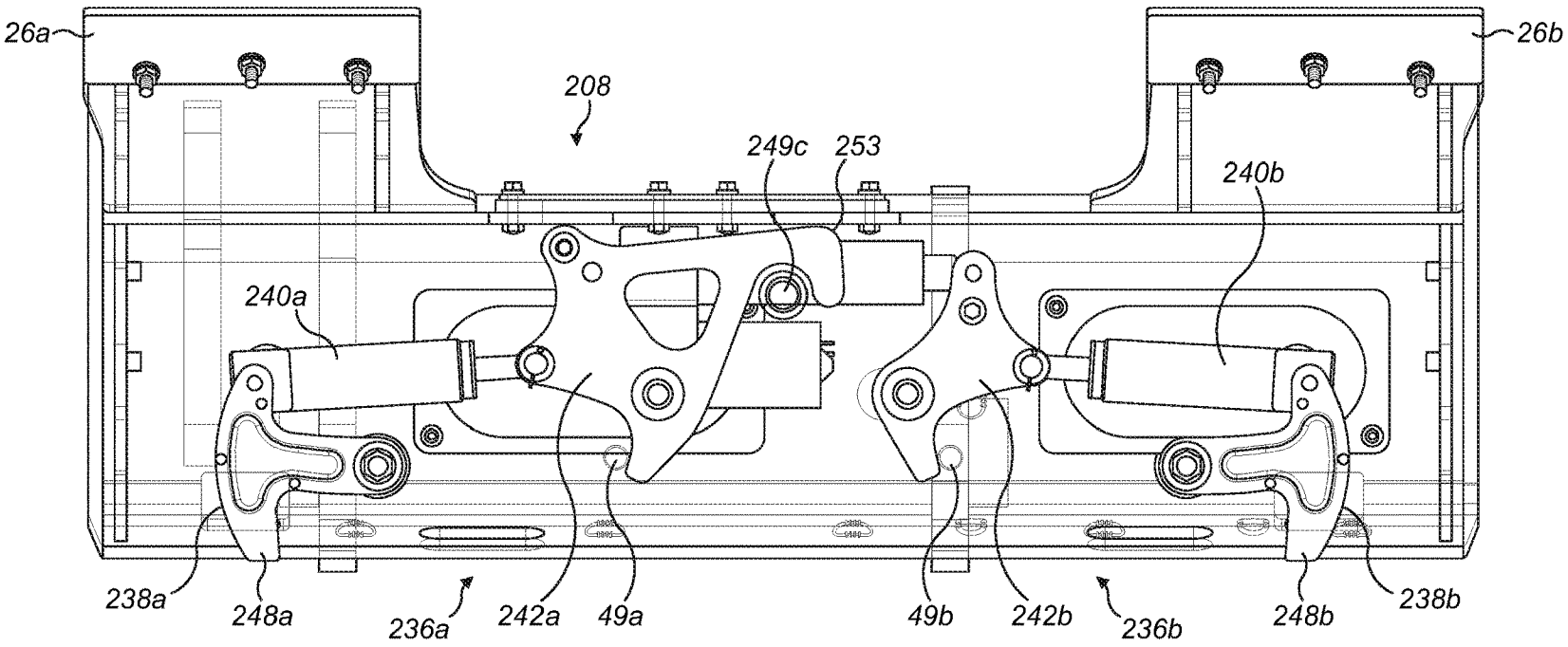
FIG. 14 is a front view of the quick hitch of FIGS. 9 to 12 in a locked position.
Figure 15:
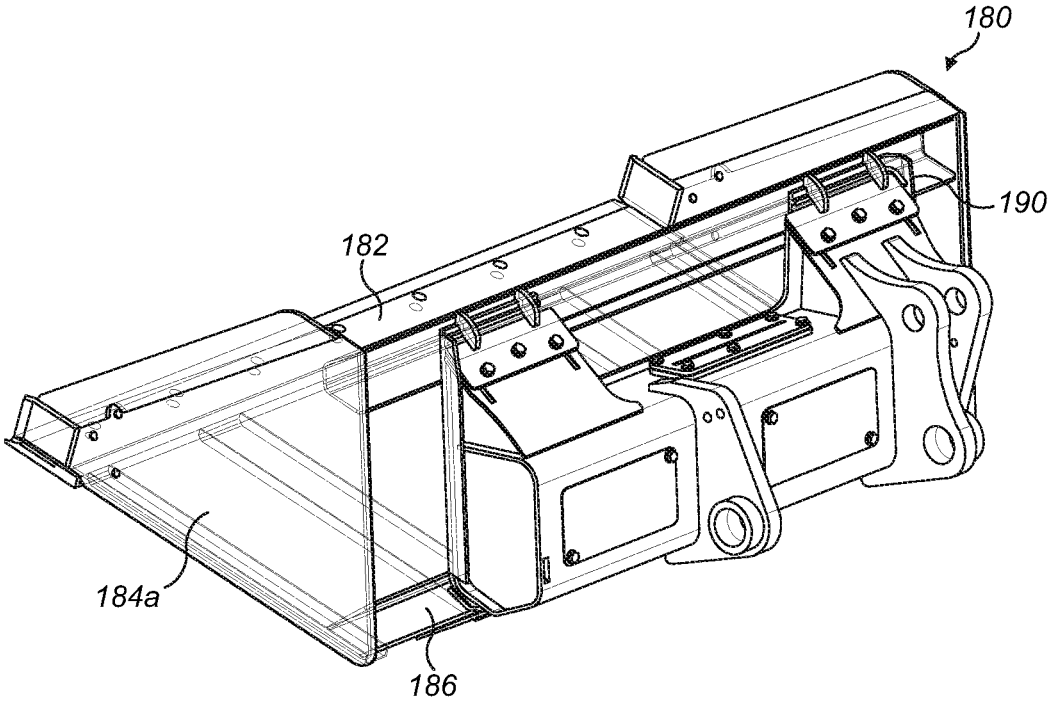
FIG. 15 is an isometric rear view of the quick hitch of FIGS. 9 to 12 connected to a shovel with the quick hitch in a locked position.
Figure 16:
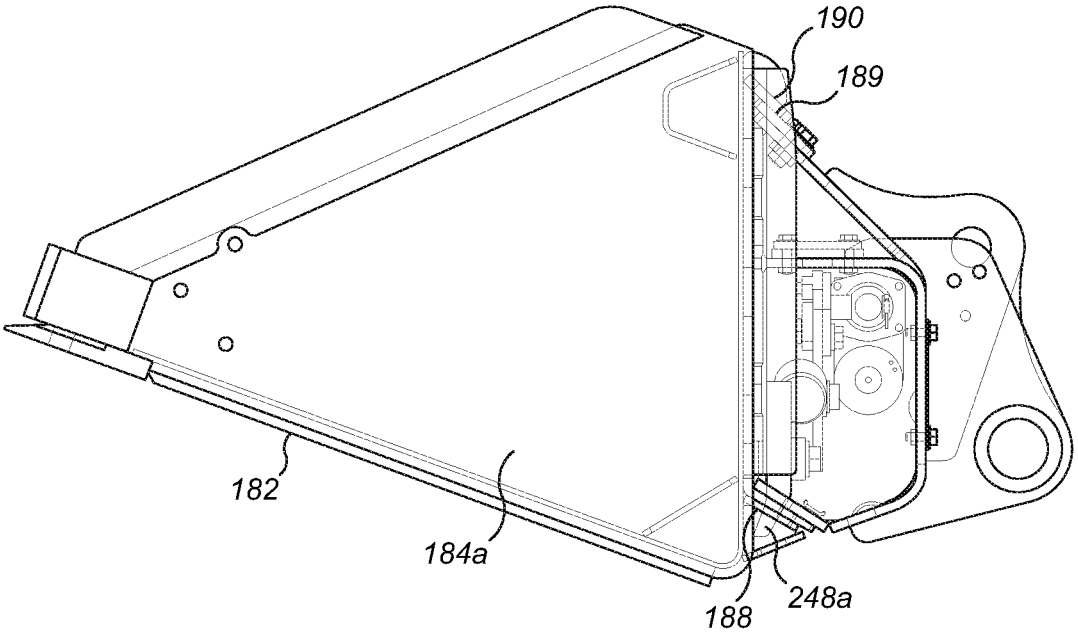
FIG. 16 is a side view of the quick hitch of FIGS. 9 to 12 connected to a shovel with the quick hitch in a locked position.

To lock the shovel 180 on the quick hitch 202, the actuator 360 is activated to move the leg 253 of the first pivotable member 242*a* from the position shown in FIGS. 9 and 10 to the position shown in FIGS. 13 and 14.

This causes the first pivotable member 242*a* to rotate in a clockwise direction such that the hook portion 253*a* of the leg 253 abuts the pin 249*c*, the second arm 266 abuts pin 49*a* and the actuator 360 is moved in an upward direction.

The rotation of the first pivotable member 242*a* causes the first link 240*a* to rotate in an anticlockwise direction.

The pivoting movement of the first link 240*a* causes the first locking member 238*a* to pivot anticlockwise relative to axis F" which causes the first projection 248*a* to move downward and to extend through aperture 28*a* in the base 14.

The first projection 248*a* engages the lower lip 188 of the shovel 180 to lock the shovel 180 to the quick hitch 202.

When the securing means 208 is in the locked position, upward movement of the first projection 248*a* is restricted by the resilient link 240*a*.

The upward movement of the actuator 360 causes the third arm 267 of the second first pivotable member 242*b* to pivot anticlockwise relative to axis A'''', the second arm 266 of the second first pivotable member 242*b* to pivot anticlockwise relative to axis D''' and the first arm 264 of the second first pivotable member 242*b* to pivot anticlockwise relative to axis E'''.

The distance travelled by the second arm 266 of the second first pivotable member 242*b* is limited by pin 49*b* against which the second arm 266 abuts when the securing means 208 in the locked position.

The pivoting movement of the second first pivotable member 242*b* causes the second end 262*b* of the second first link 240*b* to pivot anticlockwise relative to axis E''' and the first end 262*a* of the second first link 240*b* to pivot clockwise relative to axis F'''.

The pivoting movement of the second first link 240*b* causes the second locking member 238*b* to pivot clockwise relative to axis F''' which causes the second projection 248*b* to move downward and to extend through aperture 28*b* in the base 14.

The second projection 248*b* engages the lower lip 188 of the shovel 180 to lock the shovel 180 to the quick hitch 2.

When the securing means 208 is in the locked position, upward movement of the second projection 248*b* is restricted by the resilient link 240*b*.

Figure 23:
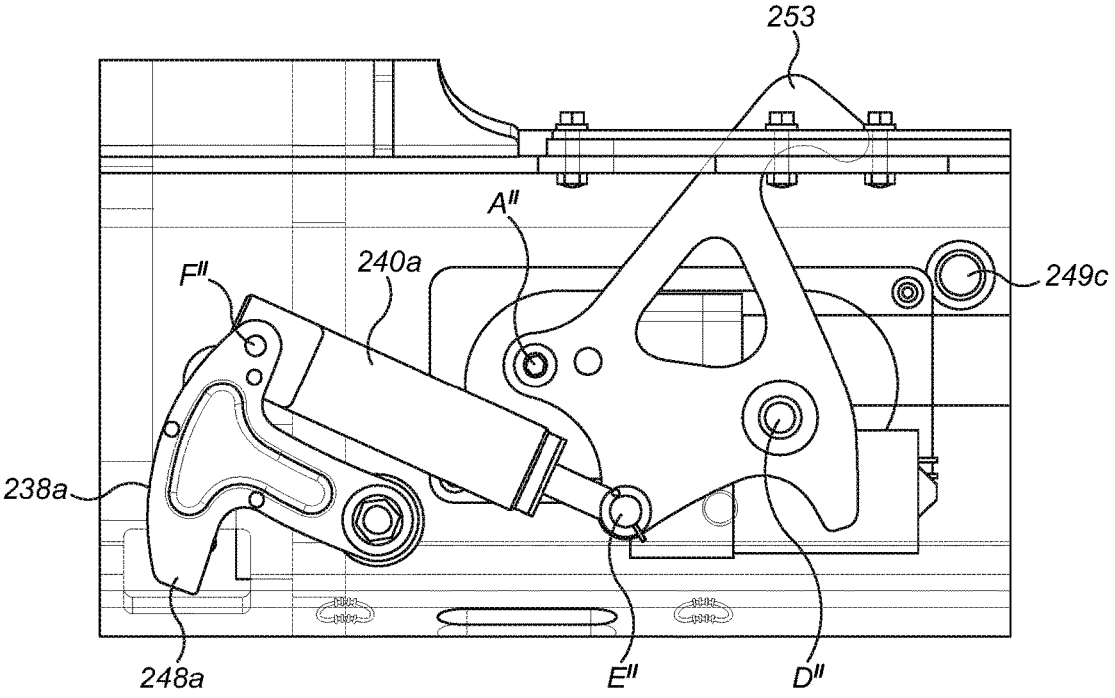
FIG. 23 is a front view of the first over-center mechanism of the quick hitch of FIGS. 9 to 12 in an unlocked position.
Figure 24:
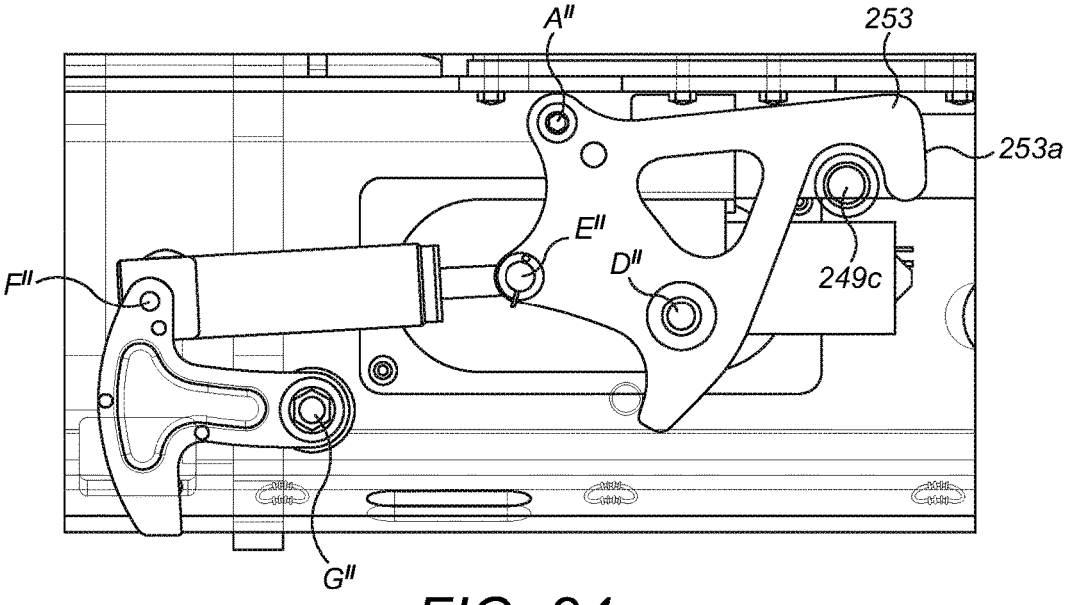
FIG. 24 is a front view of the first over-center mechanism of the quick hitch of FIGS. 9 to 12 in a locked position.

When the quick hitch 202 is secured to the shovel 180 (as shown in FIG. 23) axis E" of the first over-center mechanism 236*a* lies on a first side of a straight line drawn between axes D" and F" and when the quick hitch is not secured to the shovel (as shown in FIG. 24) axis E" lies on a second side of a straight line drawn between axes D" and F". In a similar way (not shown in the Figures) axis E''' of the second over-center mechanism 236*b* lies on a first side of a straight line drawn between axes D''' and F''' when the quick hitch 202 is secured to the shovel 180 and when the quick hitch 202 is not secured to the shovel 180, axis E''' lies on a second side of a straight line drawn between axes D''' and F'''.

In this way the first and second projections 248*a*, 248*b* are prevented from pushing against the actuator 360 when they are in the locked position.

The inclusion of a resilient, or spring-loaded, first link 240*a* on one side of the securing means 208 and a second first link 240*b* on a second side of the securing means 208 ensures positive engagement of the first and second projections 248*a*, 248*b* and keeps the securing means 208 in compression to prevent the securing means 208 from ratting, which may result in the first and second projections 248*a*, 248*b* disengaging from the lower lip 188 of the shovel 180.

The inclusion of the solid piston or plunger 368 in a hollow cylindrical body 366 having a spring 370 limits the upward movement of the first and second projections 248*a*, 248*b* to no more than 15 millimeters when the securing means 208 is in the locked position. This ensures attachment engagement at all times when the securing means 208 is in the locked position.

The position of the leg 253 of the first pivotable means 242*a* through the opening 20 in the upper surface 16 and the opening 24 in the plate 22 when the quick hitch 2 is in the unlocked position compared to the position of the leg 253 of the first pivotable means 242*a* within the body 4 of the quick hitch (i.e. not visible to an operator) indicates or provides a signal to an operator whether or not the shovel 180 is secured on the quick hitch 202.

The provision of the body 4 to enclose the securing means prevents damage being caused to the securing means 208 by dirt and debris. The provision of brushes (not shown) within the opening 24 of the plate further prevents the ingress of dirt and debris into the body 4 of the quick hitch 202.

The provision of removable plates 26*a*, 26*b* on the arm portions 18*a*, 18*b* which engage the lower surface 189 of the upper lip 190 of the shovel 180 increase the lifecycle of the quick hitch 202 as the plates 26*a*, 26*b* can be removed from the quick hitch 2 when worn and replaced with new, unworn, plates.

In the embodiments described above the quick hitches 2, 202 included wear plates 26*a*, 26*b* in addition to a body 4 for enclosing the securing means 8, 208, an over-center mechanism 36*a*, 36*b*, 236*a*, 236*b* and a resilient link 40*a*, 40*b*, 240*a*, 240*b*. It will be understood by a person skilled on the art that a quick hitch according to the present invention could include any combination of the aforementioned advantageous features.

In the embodiments described above, the plate 22 included brushes (not shown) for preventing the ingress of dirt and debris into the body 4 of the quick hitch 2, 202. It will be understood by a person skilled in the art that any suitable means for preventing the ingress of dirt and debris into the body may be employed. Alternatively the openings 20, 24 may be left substantially open.

The invention claimed is:

1. A quick hitch for mounting an implement on a machine, the quick hitch including at least one lug for connection to a machine and a securing means for securing the quick hitch to an implement, the securing means including an over-center mechanism and a locking member, the over-center mechanism including a first link and a first pivotable member, wherein the first pivotable member is pivotal at a first axis relative to a chassis of the quick hitch, a first end of the first link is pivotal at a second axis relative to a first arm of the first pivotable member, and a second end of the first link is pivotal at a third axis relative to the locking member, such that with the securing means in a first position in which the quick hitch is secured to the implement, the second axis lies on a first side of a straight line drawn between the first and third axes and, with the securing means in a second position in which the quick hitch is not secured to the implement, the second axis lies on a second side of a straight line drawn between the first and third axes, wherein the locking member includes a projection for engaging an implement when the securing means is in the first position and/or wherein the quick hitch includes a first pin and the first pivotable member includes a second arm, such that with the securing means in the first position, the second arm is in abutment with the first pin and with the securing means in the second position, the second arm is spaced from the first pin.

2. A quick hitch according to claim 1, wherein the quick hitch further includes a second pivotable member and the securing means includes a second link, wherein a first end of the second pivotable member is pivotal at a fourth axis relative to the chassis of the quick hitch, a first end of the second link is pivotal at a fifth axis relative to the second pivotable member, and a second end of the second link is pivotal at a sixth axis relative to the first pivotable member, such that with the securing means in the first position, the fifth axis lies on a first side of a straight line drawn between the fourth and six axes and with the securing means in the second position, the fifth axis lies on a second side of a straight line drawn between the fourth and six axes.

3. A quick hitch according to claim 2, wherein a second end of the second pivotable member is an actuator for moving the securing means from the first position to the second position, wherein the actuator is manual, and wherein the actuator comprises a single handle.

4. A quick hitch according to claim 3, wherein the second end of the second pivotable member includes a signal means, the signal means having a first position for signaling that the quick hitch is secured to an implement when the securing means is in the first position and a second position for signaling that the quick hitch is not secured to an implement when the securing means is in the second position.

5. A quick hitch according to claim 2, wherein the first link and/or the second link is a resilient link.

6. A quick hitch according to claim 1, wherein the securing means includes an actuator that is operably connected to the first pivotable member such that actuation of the actuator causes the securing means to move from the first position to the second position, wherein the actuator is a screw actuator and/or wherein the actuator is an electric actuator.

7. A quick hitch according to claim 6, wherein the quick hitch includes a second pin and the first pivotable member includes a leg, such that with the securing means in the first position, the leg is in abutment with the second pin and with the securing means in the second position, the leg is spaced from the second pin, wherein the leg includes a signal means, the signal means having a first position for signaling that the quick hitch is secured to an implement when the securing means is in the first position and a second position for signaling that the quick hitch is not secured to an implement when the securing means is in the second position and/or wherein the first link is a resilient link.

8. A quick hitch according to claim 1, wherein the over-center mechanism of the securing means is a first over-center mechanism, the locking member is a first locking member, the first link is a first first link, the first pivotable member is a first first pivotable member, the first axis is the first first axis, the second axis is the first second axis, the first arm of the first first pivotable member is the first first arm and the third axis is the first third axis, the securing means further including a second over-center mechanism and a second locking member, the second over-center mechanism including a second first link and a second first pivotable member, wherein the second first pivotable member is pivotal at a second first axis relative to a chassis of the quick hitch, a first end of the second first link is pivotal at a second second axis relative to a second first arm of the second first pivotable member, and a second end of the second first link is pivotal at a second third axis relative to the second locking member, such that with the securing means in a first position, in which the quick hitch is secured to an implement, the second second axis lies on a first side of a straight line drawn between the second first and second third axes and with the securing means in a second position, in which the quick hitch is not secured to an implement, the second second axis lies on a second side of a straight line drawn between the second first axis and second third axis, and/or wherein the quick hitch further includes an enclosure and/or wherein the quick hitch further includes at least one removable plate for engagement with a surface of an implement.

9. A quick hitch for mounting an implement on a machine, the quick hitch including at least one lug for connection to the machine and a securing means for securing the quick hitch to the implement, the securing means including a locking member and a first pivotable member, wherein the locking member and the first pivotable member are connected by a resilient link; the securing means having a first position in which the quick hitch is secured to the implement and a second position in which the quick hitch is not secured to the implement, wherein when the securing means is in the first position, the resilient link allows movement of the securing means to a third position which is between the first position and the second position; and wherein the securing means further includes a first link, a first pivotable member and a second link, wherein the first pivotable member is pivotal at a first axis relative to a chassis of the quick hitch, a first end of the first link is pivotal at a second axis E relative to a first arm of the first pivotable member, a second end of the first link is pivotal at a third axis relative to the locking member, a first end of the second pivotable member is pivotal at a fourth axis relative to the chassis of the quick hitch, a first end of the second link is pivotal at a fifth axis relative to the second pivotable member, and a second end of the second link is pivotal at a sixth axis relative to the first pivotable member, wherein one or more of the first link, the first pivotable member, the second link and/or the second pivotable member may be the resilient link and/or wherein the first link is the resilient link and/or wherein the quick hitch includes a first pin and the first pivotable member includes a second arm, such that with the securing means in the first position, the second arm is in abutment with the first pin and with the securing means in the second position, the second arm is spaced from the first pin and/or wherein the second pivotable member includes a signal means, the signal means having a first position for signaling that the quick hitch is secured to an implement when the securing means is in the first position and a second position for signaling that the quick hitch is not secured to an implement when the securing means is in the second position and/or wherein the locking member is pivotally connected to the resilient link and/or wherein the second pivotable member is a manual actuator, wherein the manual actuator comprises a single handle.

10. A quick hitch according to claim 9, wherein the locking member has a first position when the securing means is in the first position and a second position when the securing means is in the third position and the first and second positions of the locking member are separated by an axial distance, wherein the axial distance is less than 20 millimeters and/or wherein the axial distance is less than 16 millimeters and/or wherein the axial distance is greater than 10 millimeters and/or wherein the axial distance is greater than 12 millimeters.

11. A quick hitch according to claim 9, wherein the securing means further includes an electric actuator.

12. A quick hitch according to claim 9, wherein the locking member is the first locking member, the second pivotable member is the first second pivotable member, and the resilient link is the first resilient link, the securing means further including a second locking member and a second second pivotable member, wherein the second locking member and the second second pivotable member are connected by a second resilient link, wherein when the securing means is in the first position, the second resilient link allows movement of the securing means to a third position which is between the first position and the second position and/or wherein the quick hitch further includes an enclosure and/or wherein the quick hitch further includes at least one removable plate for engagement with a surface of an implement.

13. A quick hitch for mounting an implement on a machine, the quick hitch including at least one lug for connection to the machine and a securing means for securing the quick hitch to the implement, the securing means including a locking member and a first pivotable member, wherein the locking member and the first pivotable member are connected by a resilient link; the securing means having a first position in which the quick hitch is secured to the implement and a second position in which the quick hitch is not secured to the implement, wherein when the securing means is in the first position, the resilient link allows movement of the securing means to a third position which is between the first position and the second position;

wherein the securing means further includes an electric actuator; and wherein the electric actuator is operably connected to the second pivotable member such that actuation of the actuator causes the securing means to move from the first position to the second position and/or wherein the quick hitch includes a second pin and the second pivotable member includes a leg, such that with the securing means in the first position, the leg is in abutment with the second pin and with the securing means in the second position, the leg is spaced from the second pin, wherein the leg includes a signal means, the signal means having a first position for signaling that the quick hitch is secured to an implement when the securing means is in the first position and a second position for signaling that the quick hitch is not secured to an implement when the securing means is in the second position.

* * * * *